US007121898B2

(12) United States Patent
Murr et al.

(10) Patent No.: US 7,121,898 B2
(45) Date of Patent: Oct. 17, 2006

(54) SHIELDING CONFIGURATION FOR A MULTI-PORT JACK ASSEMBLY

(75) Inventors: Keith M Murr, York, PA (US); Michael W Fogg, Harrisburg, PA (US); Michael F Cina, Elizabethtown, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/869,131

(22) Filed: Jun. 16, 2004

(65) Prior Publication Data

US 2005/0282441 A1 Dec. 22, 2005

(51) Int. Cl.
*H01R 24/00* (2006.01)

(52) U.S. Cl. ..... 439/676

(58) Field of Classification Search ..... 439/676, 439/620, 541.5, 607–610, 490, 540.1
See application file for complete search history.

(56) References Cited

U.S. PATENT DOCUMENTS 5,531,612 A 7/1996 Goodall et al.
6,227,911 B1 5/2001 Boutros et al.
6,511,348 B1 * 1/2003 Wojtacki et al. ..... 439/620
6,655,988 B1 12/2003 Simmons et al.
6,837,742 B1 * 1/2005 Chou et al. ..... 439/541.5
6,840,817 B1 * 1/2005 Chen ..... 439/676

* cited by examiner

*Primary Examiner*—J. F. Duverne

(57) ABSTRACT

A stacked jack multi-port shielded and magnetically conditioned connector assembly is provided having a multi-port electrical connector housing having a plurality of housing ports adjacent a mating face thereof. A shield member comprises a base shield portion and sidewall portions extending from side edges of the base shield portion. The sidewall portions extend in opposite directions from the base shield portion. A plurality of modular connector subassemblies are adapted for stacking with the base shield portion positioned therebetween, and with one of the shield sidewall portions positioned against a side of one of the housings and the other shield sidewall portion is positioned against a side of the other housing.

20 Claims, 25 Drawing Sheets

SHIELDING CONFIGURATION FOR A MULTI-PORT JACK ASSEMBLY

FIELD OF THE INVENTION

The invention relates to a connection assembly providing multiple port connections, in a shielded stacked jack configuration.

BACKGROUND OF THE INVENTION

Known connector assemblies exist having multiple receptacle connectors in a common housing, which provide a compact arrangement of such receptacle connectors. Such a connector assembly is useful to provide multiple connection ports. Accordingly, such a connector assembly is referred to as a multi-port connector assembly. In preferred arrays, the housing has jacks one above the other, forming a plurality of arrays in stacked arrangement, so-called "stacked jack" arrangements. The receptacle connectors, that is, modular jacks, each have electrical terminals arranged in a terminal array, and have plug-receiving cavities. Specifically, the receptacle connectors are in the form of RJ-45 type modular jacks that establish mating connections with corresponding RJ-45 modular plugs.

For example, as disclosed in U.S. Pat. No. 5,531,612, a connector assembly has two rows of receptacle connectors, that is, modular jacks, arranged side-by-side in an upper row and side-by-side in a lower row in a common housing, which advantageously doubles the number of receptacle connectors without having to increase the length of the housing. The receptacle connectors have plug-receiving sections with plug receiving cavities that are profiled to surround modular plugs that are to be inserted in the cavities. The modular plugs have resilient latches, which engage with latching sections on the modular jacks. The latches are capable of being grasped by hand, and being resiliently bent inwardly toward the plugs to release them from engagement with the latching sections on the modular jacks.

Another design is shown in U.S. Pat. No. 6,227,911 to Boutros et al., which discloses a modular jack assembly having multiple ports for connection to multiple modular jacks. While this assembly further discloses having packaged magnetic assemblies, or other components, this design, as in other attempts to signal condition connection devices, simply adds the components to known connection devices. Therefore, the volume within the assembly is inadequate to provide the proper signal conditioning devices for the high speeds now required.

One application for such connector assemblies is in the field of telephony, wherein the modular jacks provide ports for connection with a telephone-switching network of a telephone service provider, such as a regional telephone company or national telephone company. The corresponding RJ-45 modular plugs terminate opposite ends of telephone cords leading to wall-mounted telephone outlets inside a building. The telephone outlets connect to telephone lines outside of the building, which, in turn, connect to the telephone-switching network of the telephone service provider.

Alternatively, such connection systems have found utility in office computer networks, where desktops are interconnected to office servers by way of sophisticated cabling. Such networks have a variety of data transmission mediums including coaxial cable, fiber optic cable and telephone cable. One such network topography is known as the Ethernet network, which is subject to various electrical standards, such as IEEE 802.3 and others. Such networks have the requirement to provide a high number of distributed connections, yet optimally requires little space in which to accommodate the connections.

Furthermore, such networks now operate at speeds of 1 gigabit and higher which requires significant conditioning to the signals. For instance, it is common to require shielding for controlling electromagnetic radiation per FCC standards, while at the same time controlling electromagnetic interference (EMI) within the assembly, between adjacent connections. It is therefore also a requirement to provide such components within the assembly as magnetic coils, inductors, chip capacitors, and the like, to condition the signals. While the technology exists for conditioning the signals, no connection devices exist which are capable of handling such speeds, while at the same time package the signal conditioning components required to maintain these speeds.

To add further complication to the existing infrastructure, it is now also desirable in today's building infrastructure, to provide power over the ethernet cable, thus providing power directly to the modular jack interface, that is to the so-called RJ-45 modular jack. Thus, providing power through the ethernet cable (otherwise referred to as Power-Over-Ethernet or POE) allows some power to be delivered at an ethernet interface, where power is not otherwise available.

It is known to provide approximately 16 watts through ethernet cable, whereby the power is available as a DC source at the ethernet interface. This could be used as a power source for phone usage, or to trickle charge batteries such as cell phone or laptop batteries. In this case, however, power over ethernet control cards are provided, whereby the power is controlled and conditioned to the interface of the ethernet connection.

One way of accomplishing this task is to provide a connector device on a motherboard, which receives a power over ethernet control card, which thereafter is connected to a further electrical connector device having the interface. In such cases, valuable real estate is taken up on the motherboard and also further complicates both the motherboard patterns as well as requires redundant connection devices. Moreover, from a connector-manufacturing standpoint, it is desirable to provide as many options as possible to the user and yet not require multiple and/or redundant component parts.

One multi-port electrical connector is shown in U.S. Pat. No. 6,655,988 and assigned to the present assignee, and is incorporated in its entirety herein.

Thus, the objects of the invention are to provide a connection system consistent with the needs described above.

The objects of the invention have been accomplished by providing a multi-port jack assembly, comprised of a multi-port electrical connector housing having a plurality of housing ports adjacent a mating face of the connector housing. A shield member comprises a base shield portion and sidewall portions extending from side edges of the base shield portion. The sidewall portions extend in opposite directions from the base shield portion. A plurality of modular connector subassemblies are also provided, each comprising an insulative housing assembly and electrical terminal assemblies therein. The insulative housing assemblies are adapted for stacking with the base shield portion positioned therebetween, and with one of the shield sidewall portions positioned against a side of one of the housings and the other shield sidewall portion positioned against a side of the other housing.

Preferably, the insulative housings each comprise a modular jack housing portion and a signal conditioning housing portion, and the electrical terminal assemblies are comprised of modular jack terminals and circuit board contacts.

The multi-port jack assembly may further comprise a signal conditioning board having signal conditioning components thereon positioned in the signal conditioning housing portion, with the modular jack terminals and the circuit board portions electrically connected to the signal conditioning board. The modular jack housing may be comprised of an over molded portion over the plurality of modular jack electrical terminals. The signal conditioning board may include ground traces thereon, and the shield sidewall portions may each include a tab portion extending therefrom and electrically connected to the ground traces.

The multi-port jack assembly may further comprise an outer shield portion in a substantially surrounding relation with the multi-port connector housing. The outer shield portion preferably includes a front shield wall portion and the base shield portions include grounding contacts extending forwardly and integrally therefrom and are adapted for electrical contact with the front shield wall portion.

The base shield portions may also include printed circuit grounding contacts extending integrally and rearwardly therefrom forming grounding circuit board portions.

In another aspect of the invention, a multi-port jack assembly comprises a multi-port electrical connector housing, a shield member and a plurality of modular connector subassemblies. The multi-port electrical connector housing has a plurality of housing ports adjacent a mating face of the connector housing. The shield member comprises a base shield portion and at least one sidewall portion extending from a side edge of the base shield portion. At least one insulative housing assembly has electrical terminal assemblies therein, the insulative housing assembly being positioned against the base shield portion with the shield sidewall portion positioned against a side of the housing. The modular connector assembly further comprising a signal conditioning board having signal conditioning components and a ground trace thereon, the shield sidewall portion including a tab portion extending therefrom and electrically connected to the ground trace.

The multi-port jack assembly may include a plurality of modular connector subassemblies each comprises an insulative housing assembly and electrical terminal assemblies therein. The shield member comprises at least two shield side wall portions extending in opposite directions from the base shield portion, and the insulative housing assemblies are adapted for stacking with the base shield portion positioned therebetween. One of the shield sidewall portions is positioned against a side of one of the housings and the other shield sidewall portion is positioned against a side of the other housing.

The insulative housings may each comprise a modular jack housing portion and a signal conditioning housing portion and the electrical terminal assemblies may be comprised of modular jack terminals and circuit board contacts. The signal conditioning board may have signal conditioning components thereon positioned in the signal conditioning housing portion, with the modular jack terminals and the circuit board portions electrically connected to the signal conditioning board. The modular jack housing may be comprised of an over molded portion over the plurality of modular jack electrical terminals.

The multi-port jack assembly may further comprise an outer shield portion in a substantially surrounding relation with the multi-port connector housing. The outer shield portion may include a front shield wall portion and the base shield portions may include grounding contacts extending forwardly and integrally therefrom and adapted for electrical contact with the front shield wall portion. The base shield portions include printed circuit grounding contacts extending integrally and rearwardly therefrom and form grounding circuit board portions.

BRIEF DESCRIPTION OF THE DRAWINGS

The invention will now be described by way of reference to the drawings, where.

DETAILED DESCRIPTION OF THE PREFERRED EMBODIMENTS

Figure 1:
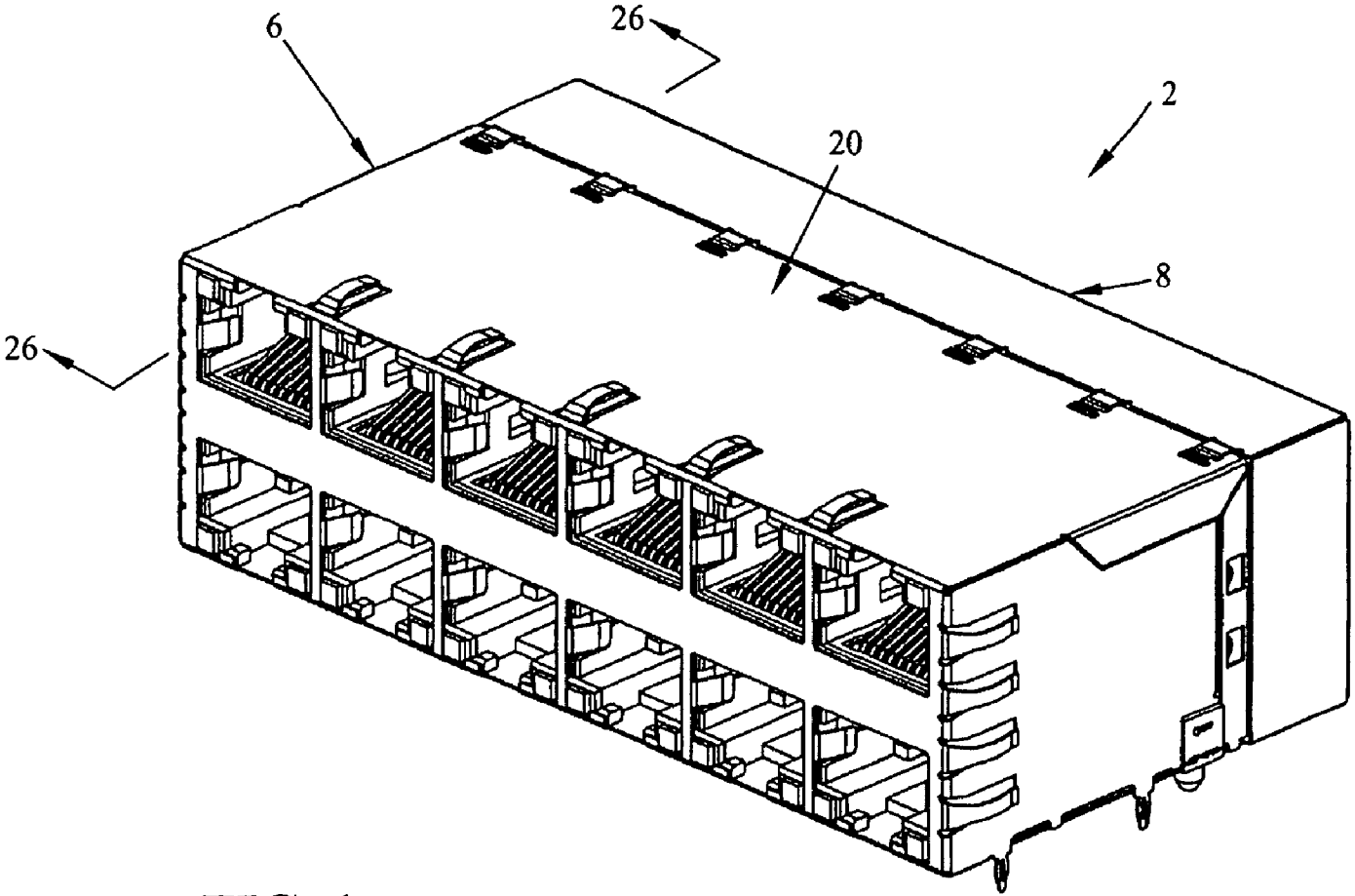
FIG. 1 is a front perspective view of the present invention with an integrated power over ethernet printed circuit board.
Figure 2:
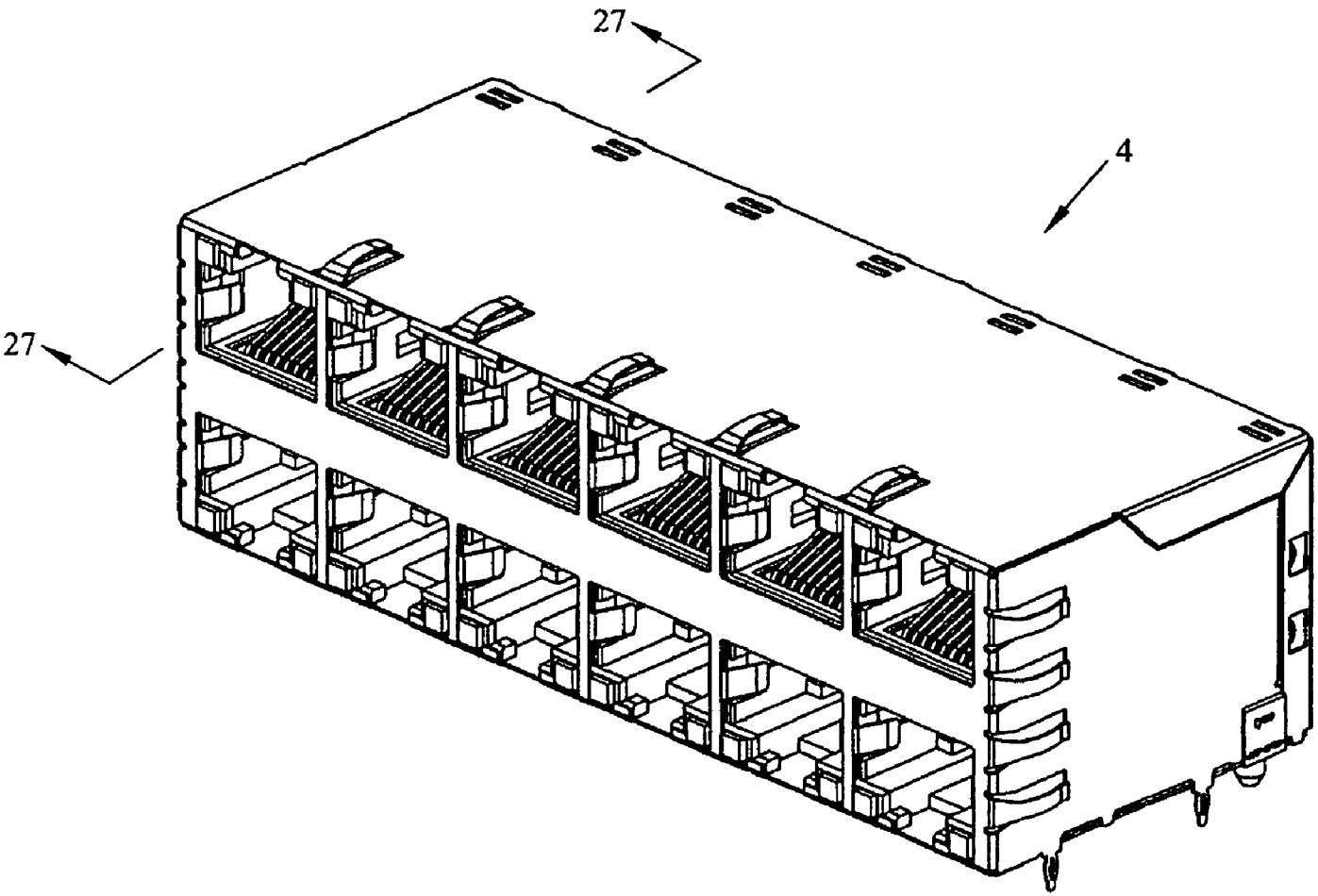
FIG. 2 shows a front perspective view of the invention as configured for stacked modular jacks enabled for external connection of power over ethernet or a stacked modular jack assembly with magnetics only.

With reference first to FIGS. 1 and 2, the various components of the present invention will be described with respect to several possible embodiments, it being understood however that the shielding configuration of the present invention being applicable to any such exemplary device. As shown in FIG. 1, a multi-port or stacked jack configuration is shown generally at 2, where the connector 2 includes an integrated power over ethernet control card. As shown in FIG. 2, an electrical connector is shown at 4, where connector assembly 4 could take on one of two configurations. First, connector 4 could be an assembly where the power over ethernet control card is not integrated with the connector, but rather is positioned elsewhere on a motherboard and the power signals are routed through a control card on the motherboard, and thereafter to connector 4. Alternatively, connector 4 could be a configuration, where no power over ethernet is required, but is rather a stacked jack assembly with magnetics only. However, in either event, that is, in either the case of the assembly 2 of FIG. 1, or the assembly 4 of FIG. 2, the connector assemblies are designed to use interchangeable components in order to maximize the interchangeability between the component parts and the various assemblies.

Continuing further and still with the general description of the components, FIG. 1 shows connector assembly 2 generally including a shielded stacked jack subassembly 6, having a rearwardly mounted power over ethernet assembly shown generally at 8. It should be appreciated, and will be more clearly pronounced herein, that shielded subassembly 6 is similar to shielded assembly 4 shown in FIG. 2 but for the power over ethernet componentry.

Figure 3:
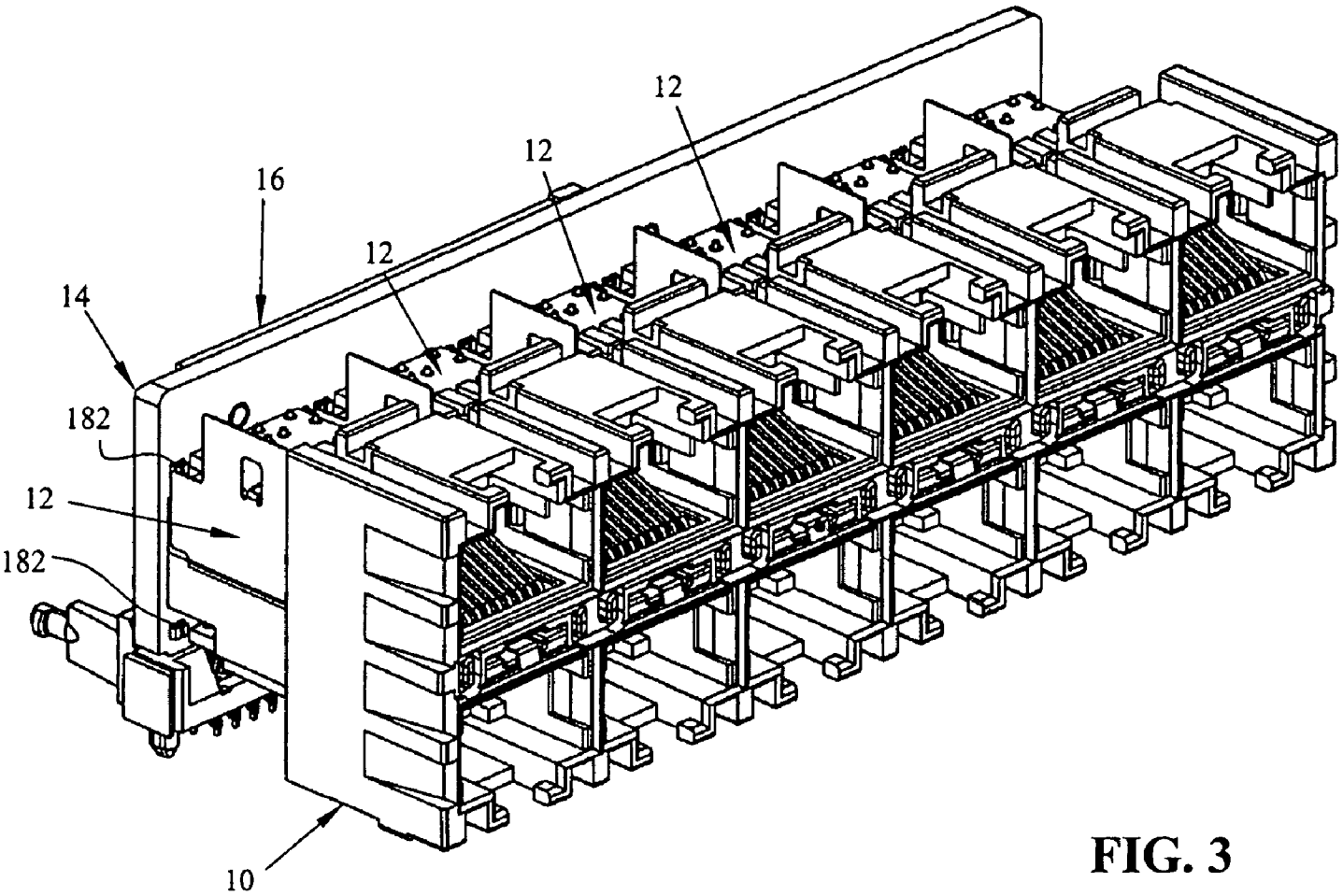
FIG. 3 is a front perspective view of the internal subassembly of the device shown in FIG. 1.
Figure 4:
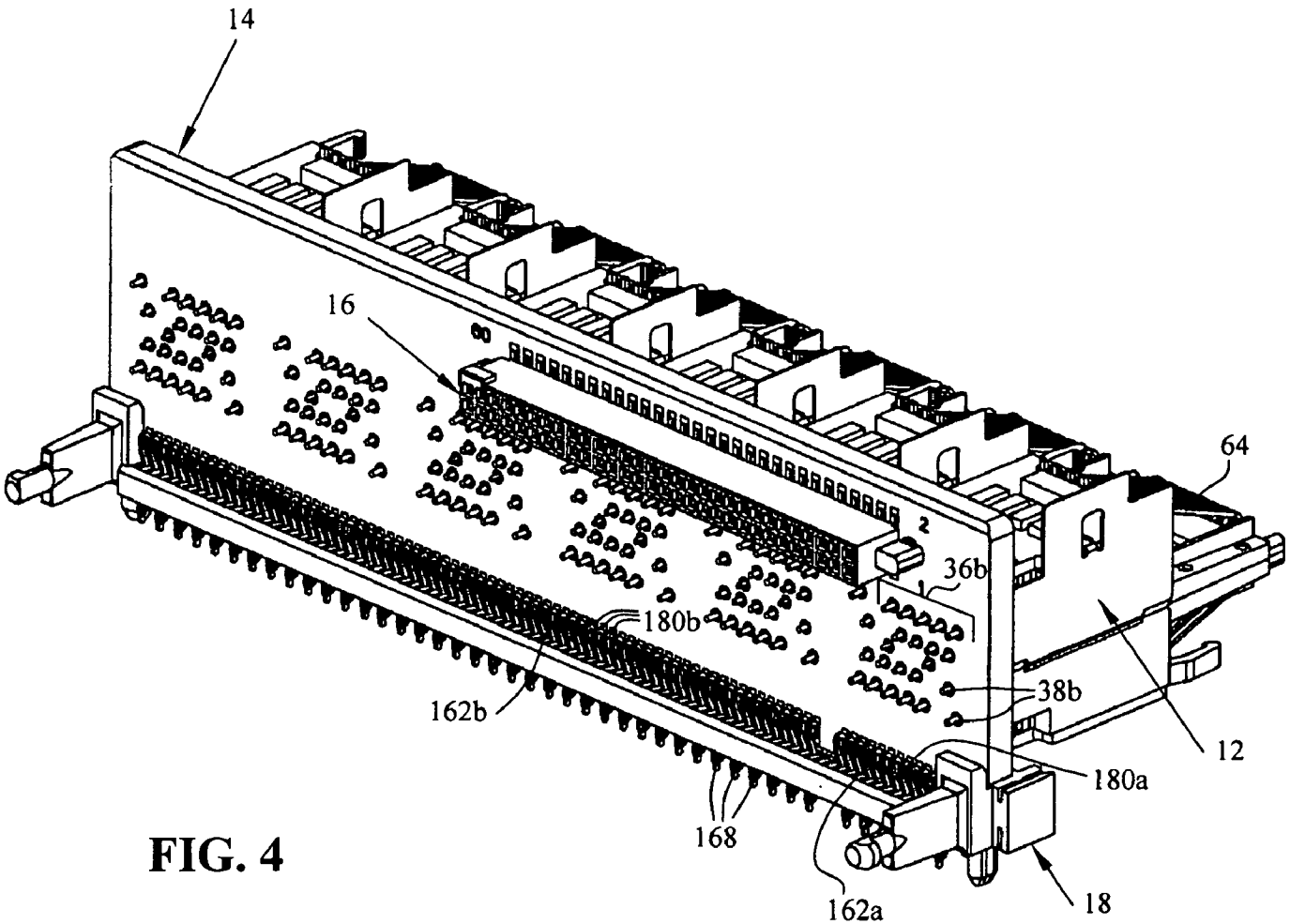
FIG. 4 is a rear perspective view of the device shown in FIG. 3.

Continuing, FIGS. 3 and 4 show the internal structure of shielded subassembly 6 including a front insulative housing assembly 10, a plurality of shielded modular jack subassemblies 12, where the modular jack subassemblies are interconnected to a main board shown at 14. The main board 14 has an electrical connector 16 for interconnection to a power over ethernet module, as described more fully herein, and wherein the main board 14 is interconnectable to an edge card connector 18. It should be appreciated that the entire assembly can be mounted to a motherboard, as will be more fully disclosed herein. It should also be appreciated that the subassembly shown in FIGS. 3 and 4 is the assembly internal to the outer shield 20 of shielded subassembly 6.

Figure 5:
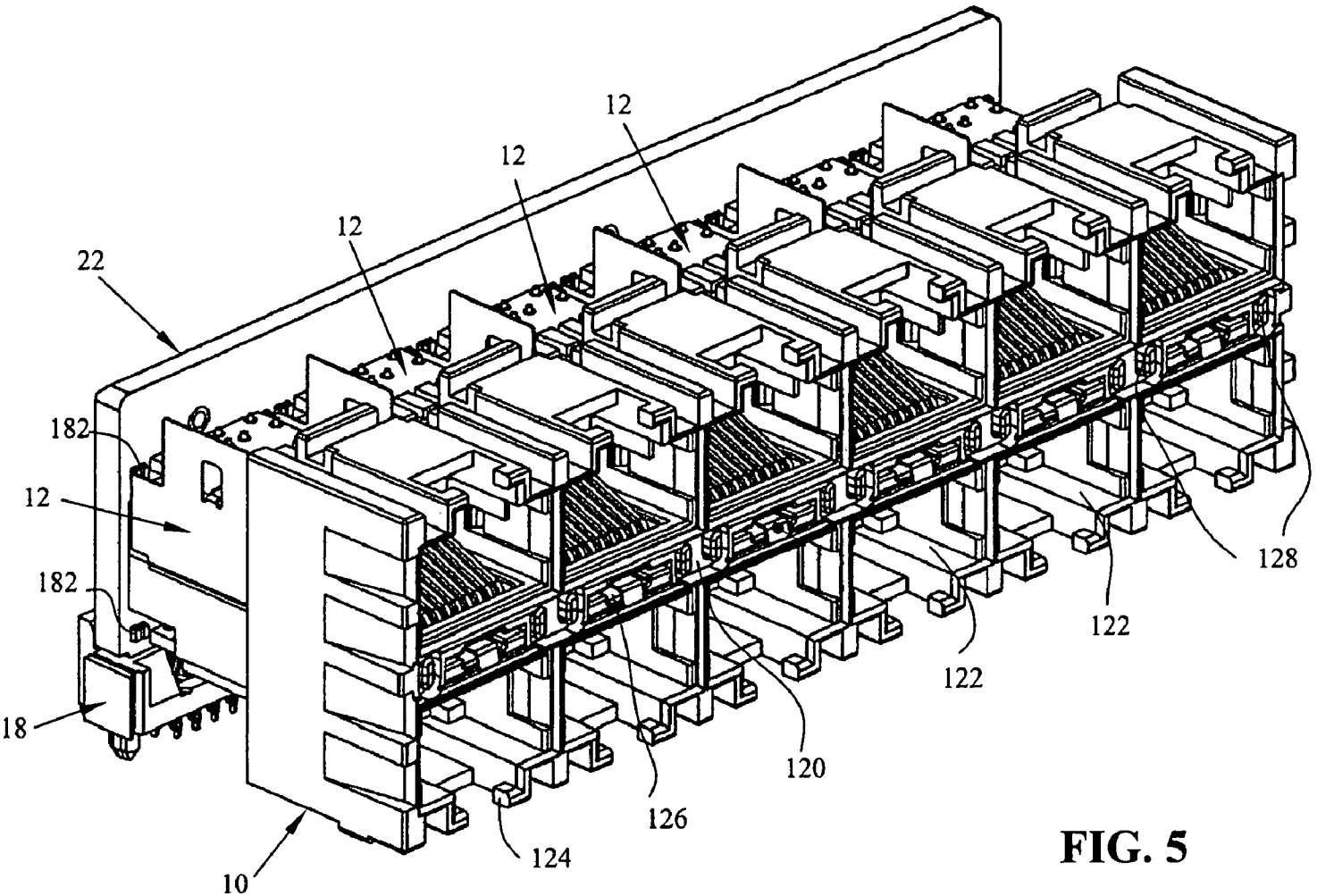
FIG. 5 is a front perspective view of the internal subassembly of the device shown in FIG. 2.
Figure 6:
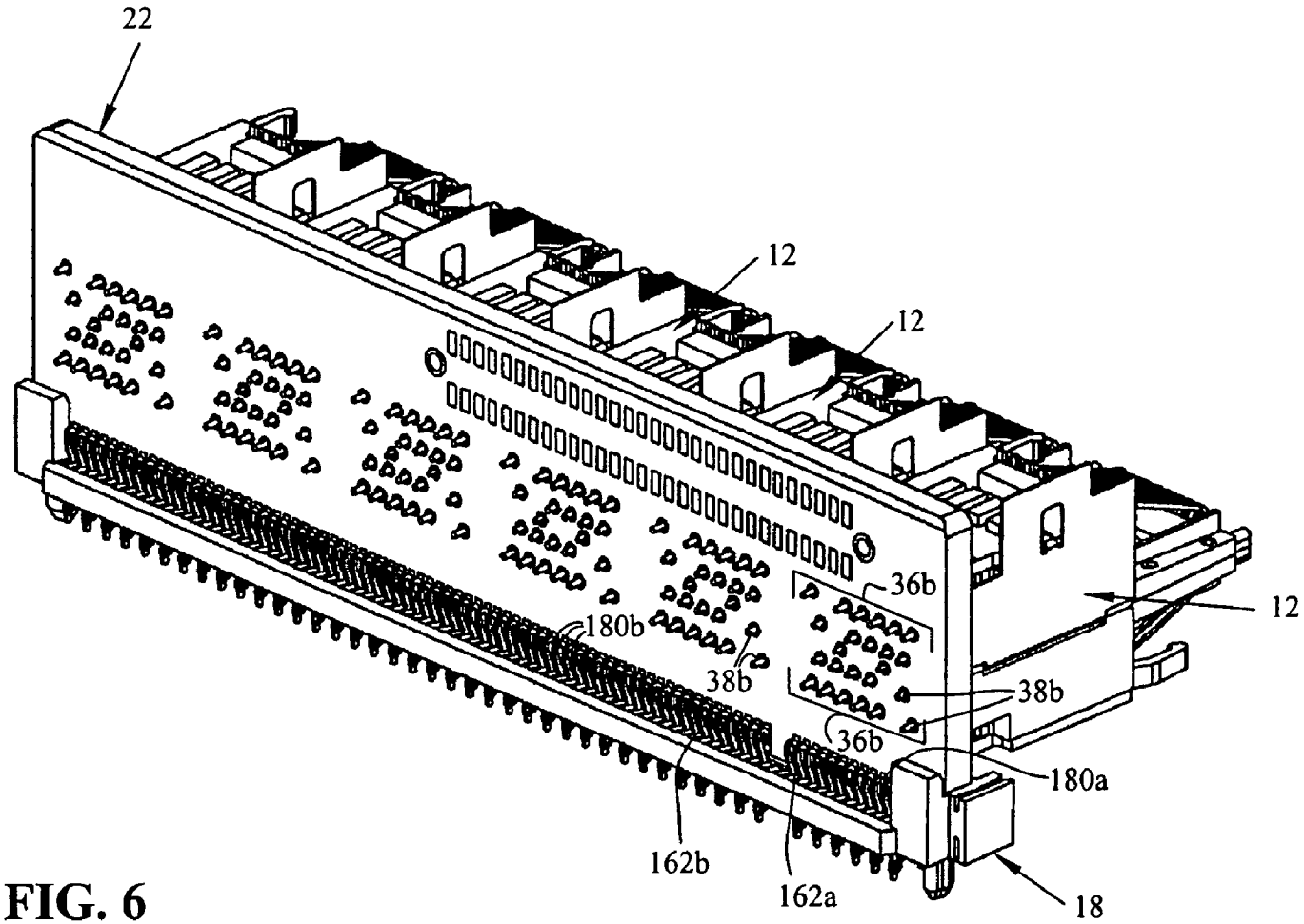
FIG. 6 is a rear perspective view of the subassembly shown in FIG. 5.

With respect now to FIGS. 5 and 6, it will be noticed first that an identical electrical connector housing 10 is utilized, as well as identical shielded modular jack subassemblies 12. A different main board 22 is provided, however, as there is no interconnection directly to a power over ethernet card. Rather, a main board 22 is provided which is interconnected to the plurality of shielded subassemblies 12, as shown best in FIG. 6. An identical edge card connector 18 can be provided, having the identical footprint for interconnection to a like footprint or configuration on a motherboard.

Figure 8:
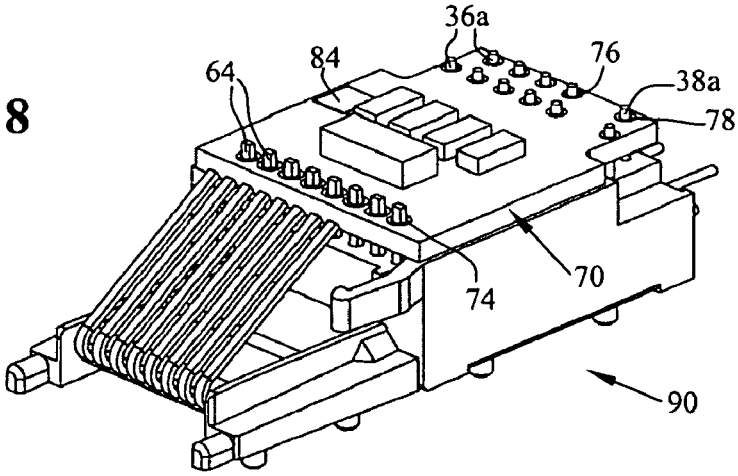
FIG. 8 shows the assembled view of the exploded components of FIG. 7.
Figure 7:
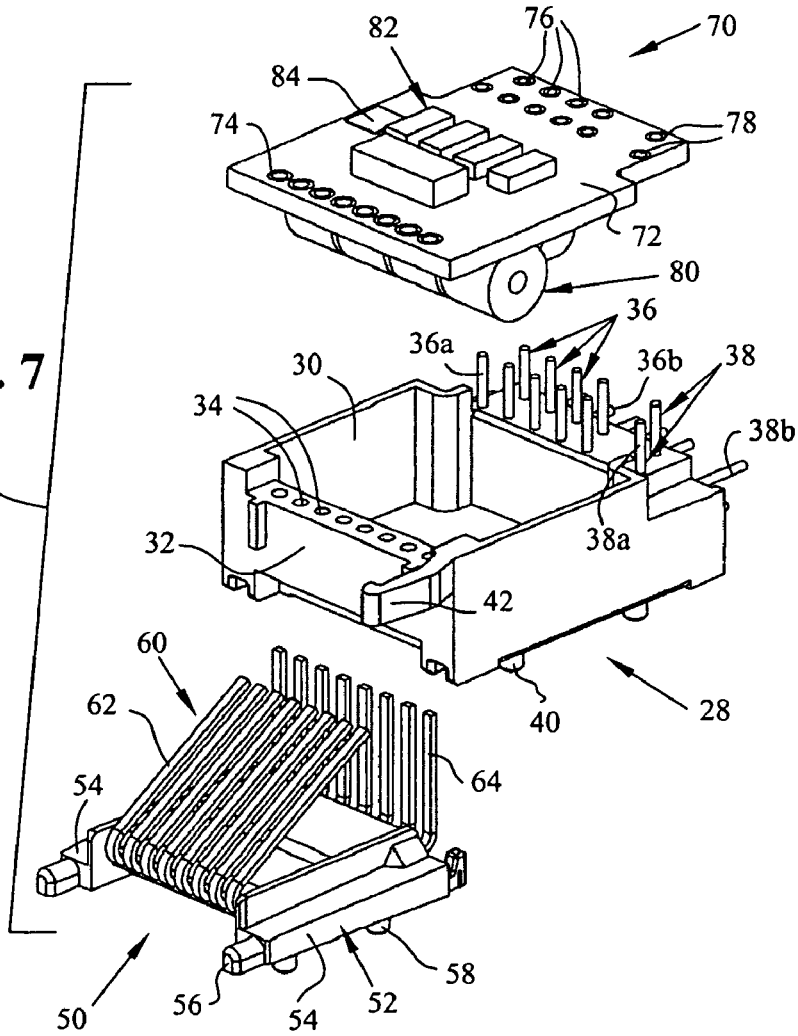
FIG. 7 shows an exploded view of the modular jack subassembly.
Figure 9:
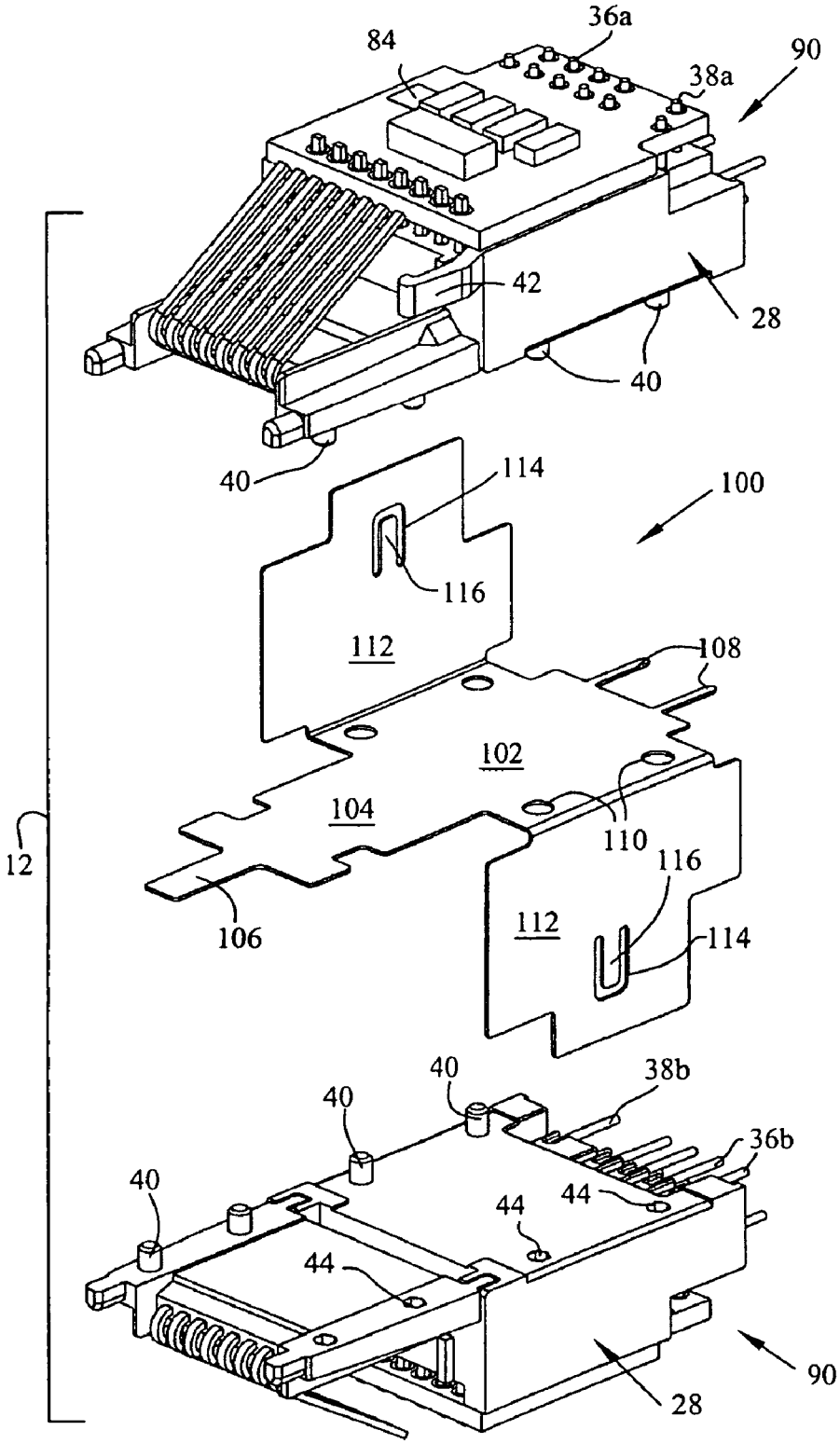
FIG. 9 shows an exploded view of two modular jack halves being interconnected to an intermediate shield.

With reference now to FIGS. 7–9, the shielded subassemblies 12 will be described in greater detail. With respect first to FIG. 7, the shielded modular jack subassemblies 12 have an insulative jack housing 28, having an inner cavity at 30 and a front wall 32, having receiving openings at 34. The housing 28 further includes signal contacts 36 and power contacts at 38, having circuit board portions 36*a*, 36*b* and 38*a*, 38*b*, respectively. Finally, the housing 28 further includes locating lugs 40 on the bottom surface of the housing 28 and a latching arm 42 extending from the front wall 32 thereof. As shown best in FIG. 9, the housings 28 also include hexagonal openings at 44.

The subassembly further includes a jack housing 50, having an insulative housing 52, where the housing includes locating side walls 54, having locating pegs 56 at a front end thereof, and locating lugs 58 on a bottom surface thereof. The jack further includes electrical terminals 60 profiled as modular jack terminals, having reversely bent contact portions at 62 and printed circuit board tines at 64.

As also shown in FIG. 7, the subassembly 12 includes a magnetic package 70 comprised of a printed circuit board 72, having plated throughholes at 74 at a front edge thereof, plated throughholes 76 at a rear edge thereof for signal contacts, and plated throughholes 78 for power contacts. Finally, suppression devices, such as magnetics 80 and/or components 82, are included for suppression-device purposes, as is well known in the art. Finally, the printed circuit board 72 includes a grounding pad at 84 terminated to one of the signal terminals 76 for grounding purposes, as will be described herein.

With respect to FIG. 8, a modular jack subassembly is shown at 90, which is the assembly of components of FIG. 7, and as should be appreciated, printed circuit board tines 64 are positioned through apertures 34 of housing 28 and through throughholes 74 of printed circuit board 70. At the same time, contacts 36*a* project through throughholes 76, while contact portions 38*a* project through apertures 78. Meanwhile, the majority of the suppression devices 80 are positioned within the cavity 30 of housing 28 for a low-profile package. At this point, the contact tines 64, 36*a* and 38*a* may be soldered to their associated plated throughholes 74, 76, 78, respectively.

With respect now to FIG. 9, two such modular jack subassemblies 90 are shown top-to-bottom and disposed on opposite sides of a shield member 100, where shield 100 includes a base plane 102, having a forwardly extending tongue 104, having a grounding tab at 106 and grounding tines 108 extending from the opposite end thereof. Base plate 102 further includes apertures 110. Side wings 112 extend upwardly from one side of the base plate 102 and downwardly from an opposite side edge of the base plate 102 to form upwardly and downwardly extending shield walls, where each of the walls includes a U-shaped cutout portion 114 defining a bendable tab 116. It should be appreciated that the two modular jack subassemblies 90 can be moved towards each other, trapping the shield member therebetween, where pegs 40 align with openings 110 in the shield and with hexagonal openings 44 in the opposite side of the opposite housing 28.

Figure 11:
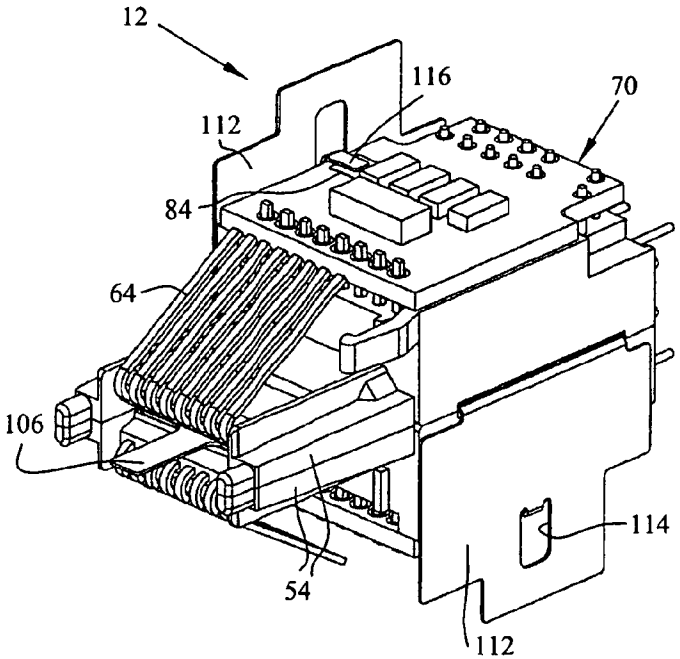
FIG. 11 shows a front perspective view of the assembled modular jack assembly shown in FIG. 10.
Figure 10:
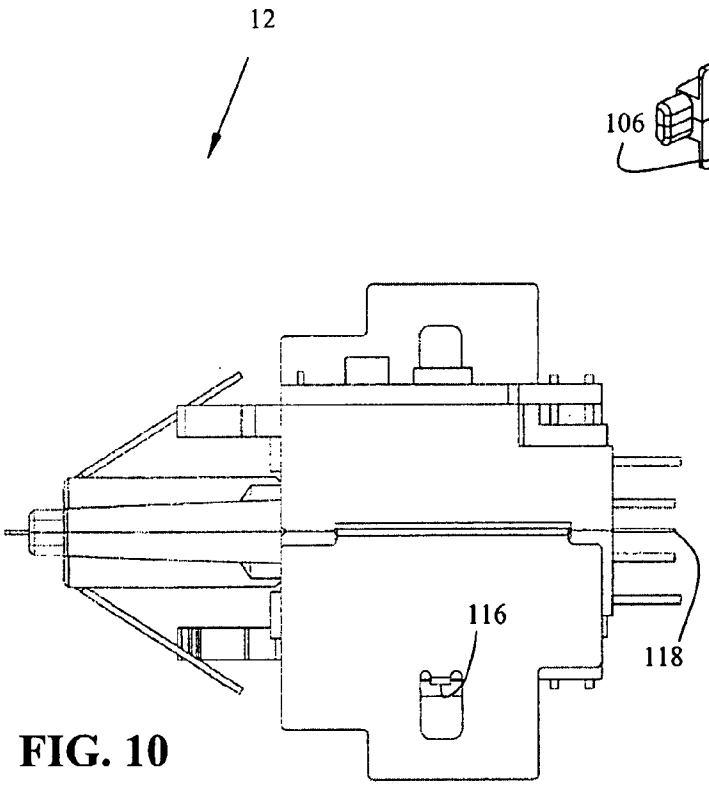
FIG. 10 shows a side view of the assembled components of FIG. 9.

With respect now to FIGS. 10 and 11, the subassembly 12 is completed by bending tabs 116 downwardly over ground pad 84 and can be soldered in place to ground the shields thereto. It should also be appreciated that, from a mechanical standpoint, the two housings 28 can be held together by a frictional press fit between the pegs 40 and apertures 44, or could be held together by any means known, such as ultrasonic welding, adhesives, thermal bonding, or any other known means. However, as defined, and assembled in FIGS. 10 and 11, the subassembly 12 is shown with the modular jack contacts 60 having contact portions 62 positioned in a reversely bent manner towards the front end of the shielded subassembly, with the tab 106 of the ground member 100 extending forwardly therefrom and with ground tines 108 extending rearwardly therefrom.

With respect now to FIG. 5, insulative housing 10 will be described in greater detail. As shown in FIG. 5, housing 10 includes a front mating face 120, defining a plurality of ports 122, where each port includes a latching structure 124 for a well-known modular plug configuration, as is well known in the art. The front mating face 120 also includes a central opening at 126 flanked by two oval-shaped openings at 128. As shown best in FIG. 27, the housing 10 further includes a rear face at 130, top wall 132, bottom wall 134, and side walls 136. Each port 122 includes a set of comb-like members 140, as is also well known in the modular jack art, which defines grooves for receiving the reversely bent contact portions 62 of the modular jacks.

Housing 10 further includes vertical walls 144, which defines vertically stacked pairs of ports 122, where each of the walls is profiled to receive the pair of side edges 54 (FIG. 11) to align the shielded subassemblies 12 therein. Rear face 130 further includes a plurality of diametrically opposed latching openings, (not shown). Finally, as shown in FIG. 3, top wall portion 132 includes channels 150 generally defined by axially extending channels 152 flanking the latch portion 124 and a transverse groove portion 154 positioned on extension portions 156.

Figure 26:
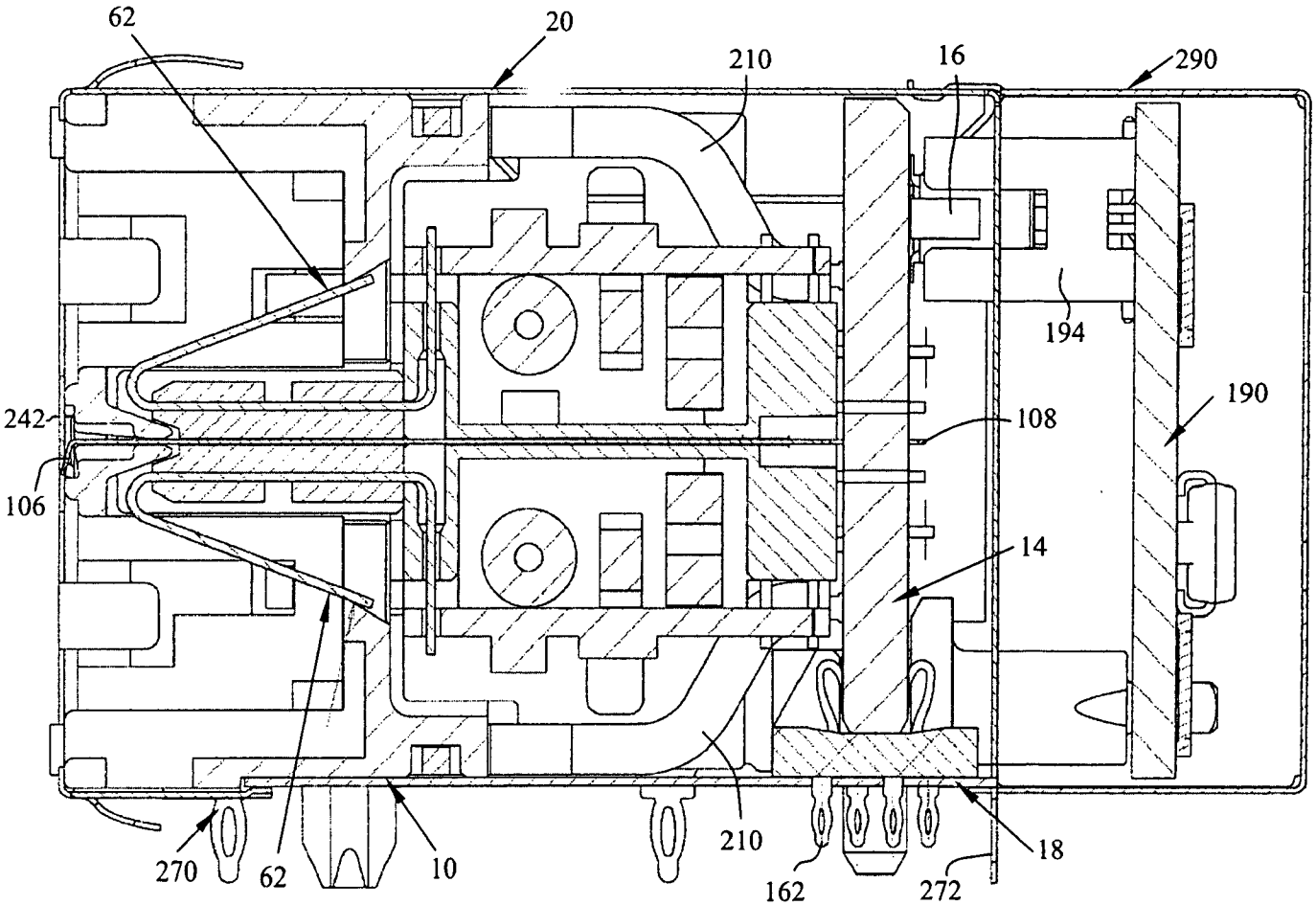
FIG. 26 shows a cross-sectional view through lines 27—27 of FIG. 1.

The shielded subassemblies 12 as configured in FIGS. 10 and 11 are positionable within the housing 10. The connector housing 10 and shielded subassemblies are assembled by positioning the individual contacts 62 into the grooves defined by the comb-like members 140 (FIG. 26). This positions the posts 56 into and through the openings 128 (as shown in FIG. 5) and positions the latch arms 42 (FIG. 9) into respective pairs of openings. Posts 56 may be latching members, may be "heat-staked" in place or may be adhesively fixed in place.

It should be appreciated that by stacking multiple subassemblies side by side, that the shielded subassemblies are completely shielded as between them. In other words, as the subassemblies 12 are stacked one against the other, one shield sidewall portion 112 is positioned downwardly and the other shield sidewall portion 112 is positioned upwardly. However, in the next adjacent subassembly 12 has a downwardly extending shield sidewall portion 112 that complements the shield sidewall portion 112 of the previously inserted subassembly. Thus, the asymmetrically configured shield member 100 provides a complete shielding wall when assembled as described.

With respect now to FIGS. 12 and 13, connector 18 will be described in greater detail. Connector 18 is a typical configuration of an edge card connector, having a housing 160 and a plurality of contacts 162. Housing 160 defines a slot 164 for receiving therein an edge card, with contacts 162 defining opposed contacts 166 flanking the opening 164. Terminals 162 further include printed circuit board contact portions 168, and preferably, the contact portions 168 are in the form of a press-fit-style contact with a throughhole of a printed circuit board, and in the embodiment shown, are "eye-of-the-needle"-style contacts. Housing 160 further includes optional rearwardly extending latching arms 170, having a latch member 172. (Optional depending upon whether the power over ethernet board is integrated with the assembly.) Top beams of contacts provide flexibility after solder (or solderless) connection to pads 180*a* or 180*b* on the main board. This provides expansion, contraction and tolerance allowances.

Figure 12:
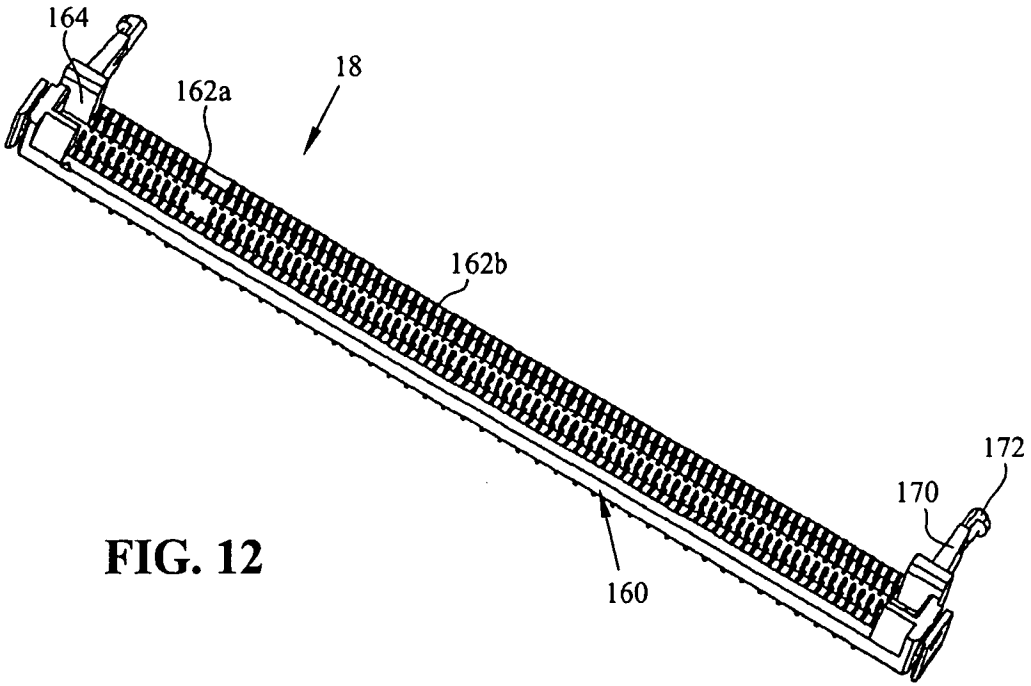
FIG. 12 shows a printed circuit board connector for use for interconnecting one of the main boards to a motherboard.
Figure 13:
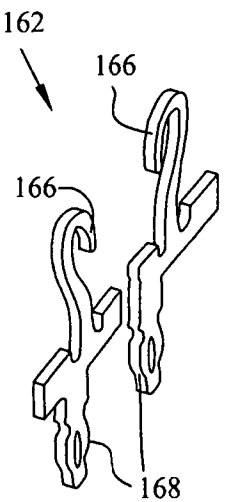
FIG. 13 shows the electrical contacts used in the connector of FIG. 12.
Figure 14:
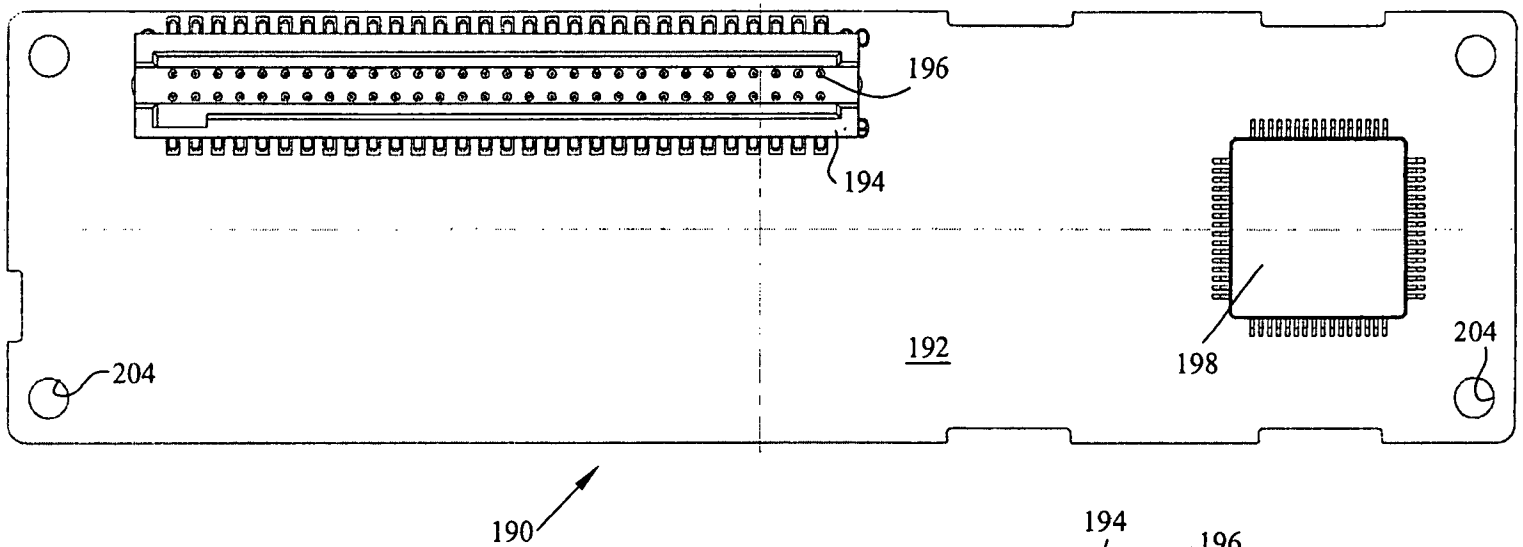
FIG. 14 shows a front plan view of the power over ethernet control card.
Figure 15:
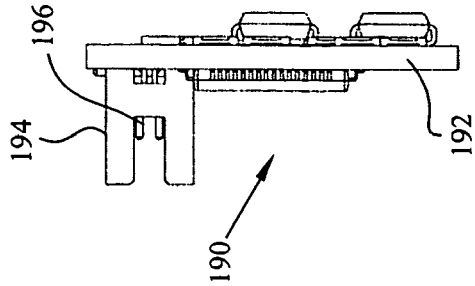
FIG. 15 is an end view of the card shown in FIG. 14.
Figure 17:
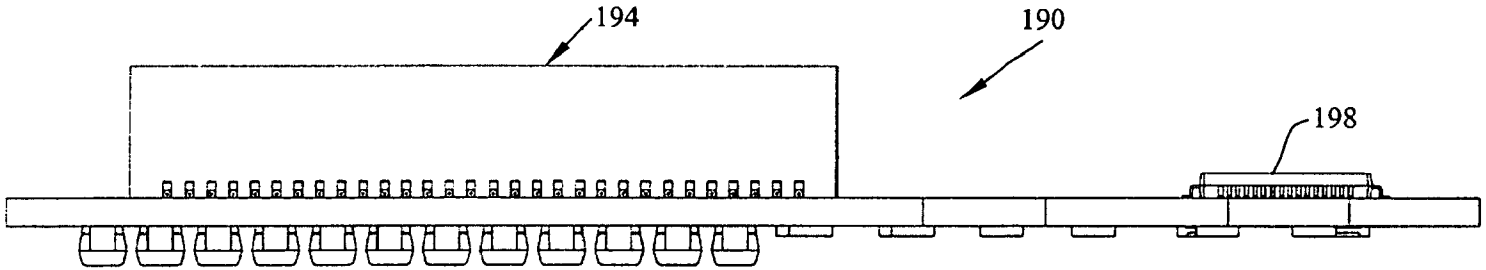
FIG. 17 is a side view of the card shown in FIG. 16.
Figure 16:
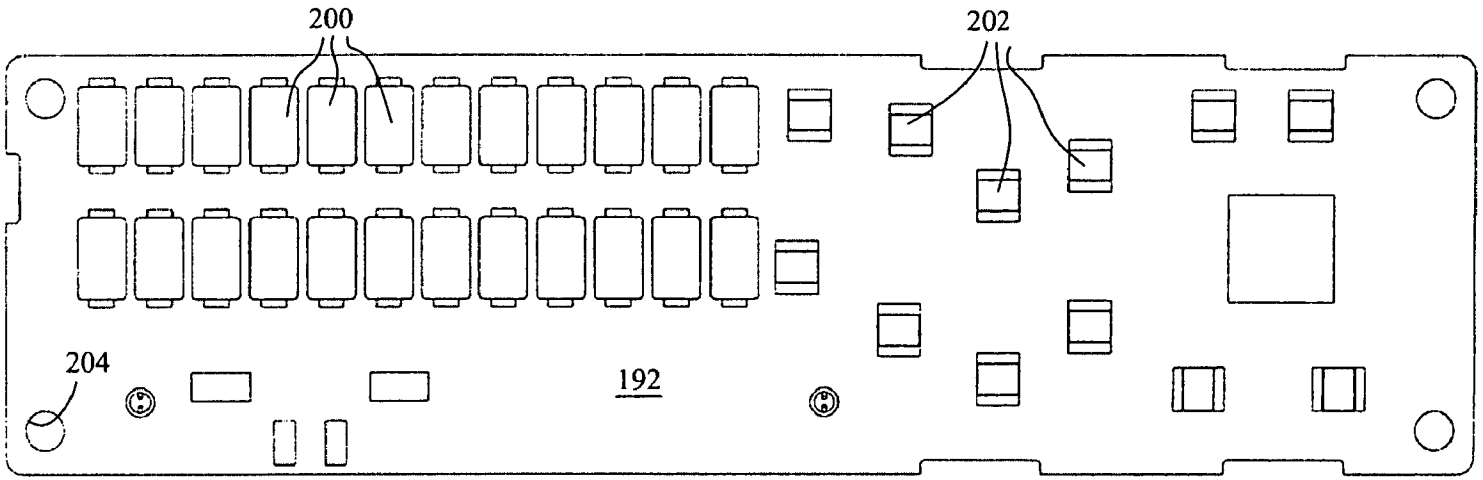
FIG. 16 is a rear plan view of the card shown in FIGS. 14 and 15.

As shown in FIG. 12, the contacts 162 are designated into separate sets, where contacts 162*a* is a designated set for power, whereas designated set 162*b* is provided for signal. In the embodiment shown, positions 1 through 24, that is, designated set 162*a*, is provided for power, that is, two terminals per port for a 6×2 configuration, or 12 ports. The remainder of the contacts 162*b* is provided for signal contacts, that is, for the data contacts utilized by the modular jack contacts 60.

With respect now to FIGS. 3 and 4, a first optional configuration of the main board 14 will be described, where it relates to the inclusion of the power over ethernet board as being integrated with the overall assembly. It should first be described that main board 14 has two separate functions, the first function providing the interconnect between the modular jack terminals 60 and compliant contact portions 168. The second separate function is to provide the interface for the integrated power over ethernet card through connector member 16.

Thus, in the configuration of FIG. 4, that is, where the power over ethernet card is integrated into the connection system, the main board 14 not only provides for the path for the signal contacts 162*b*, but also provides for the path for the power through contacts 162*a* and further provides for a connection device 16, which will condition and control the power through contacts 162*b*. Thus, as shown in FIG. 4, the contact pads 180*a* on main board 14, which connect to the designated power contacts 162*a*, are also directly connected through the printed circuit board to connector 16. Meanwhile, as also shown, other throughholes on main board 14 are interconnected to signal contact portions 36*b* of shielded subassembly 12 and to power contact portions 38*b* of shielded subassembly 12.

In the case of main board 22, that is, where the board 22 is enabled for use with a power over ethernet control card, no connector 16 is required. In this case, contacts 162*b* provide the identical function as in the case of the integrated board 14, that is, providing the direct interconnect between the compliant pin portions 168 and the data contacts of the modular jacks. However, in the case of the power contacts 162*a*, while they are still interconnected to traces 180*a* on board 22, these traces 180*a* are directly interconnected to the various power contacts 38*b* of the modular jack subassemblies 12. Said differently, in the case of the enabled version of FIGS. 5 and 6, while there is a power over ethernet card, the card is located elsewhere on the overall system, for example, on the motherboard to which this overall assembly is connected. Thus, the power lines on the motherboard, which interconnect to designated power contacts 162*a*, are already controlled by the power over ethernet card. Thus, the various routings between traces 180*a* and connector 16 are not required and hence, are simply routed directly to the various power terminals 38*b*.

Finally, and in another configuration, where no power over ethernet card is required, a card similar to 22 can be provided but be slightly modified in its overall function. If no power over ethernet is required, then contacts 162*a* could be left out or could be left in for mechanical retention of the connector 18 to the board, but the throughholes to which they connect are dummy holes only for mechanical-retention purposes. In other words, in the version where no power over ethernet is required, no power is transferred through contacts 162*a*, which is accomplished by one of two ways, as described above.

In either event, that is, with either main board 14 or 22, it is preferable to provide an indication of the condition of the various ports, and for that purpose light emitting diodes (LEDs) 182 are provided on either board 14, 22 as shown in FIGS. 3 and 5. The precise function of the LEDs will be further described herein.

With respect now to FIGS. 14 through 17, the power over ethernet card is shown at 190 as including a printed circuit board 192 having a connector at 194. It should be appreciated that the connector 194 has a plurality of contacts 196, which are profiled to mate with corresponding contacts in connector 16. Furthermore, power over ethernet card 190 includes control device 198 and a plurality of active devices 200, 202.

Figure 18:
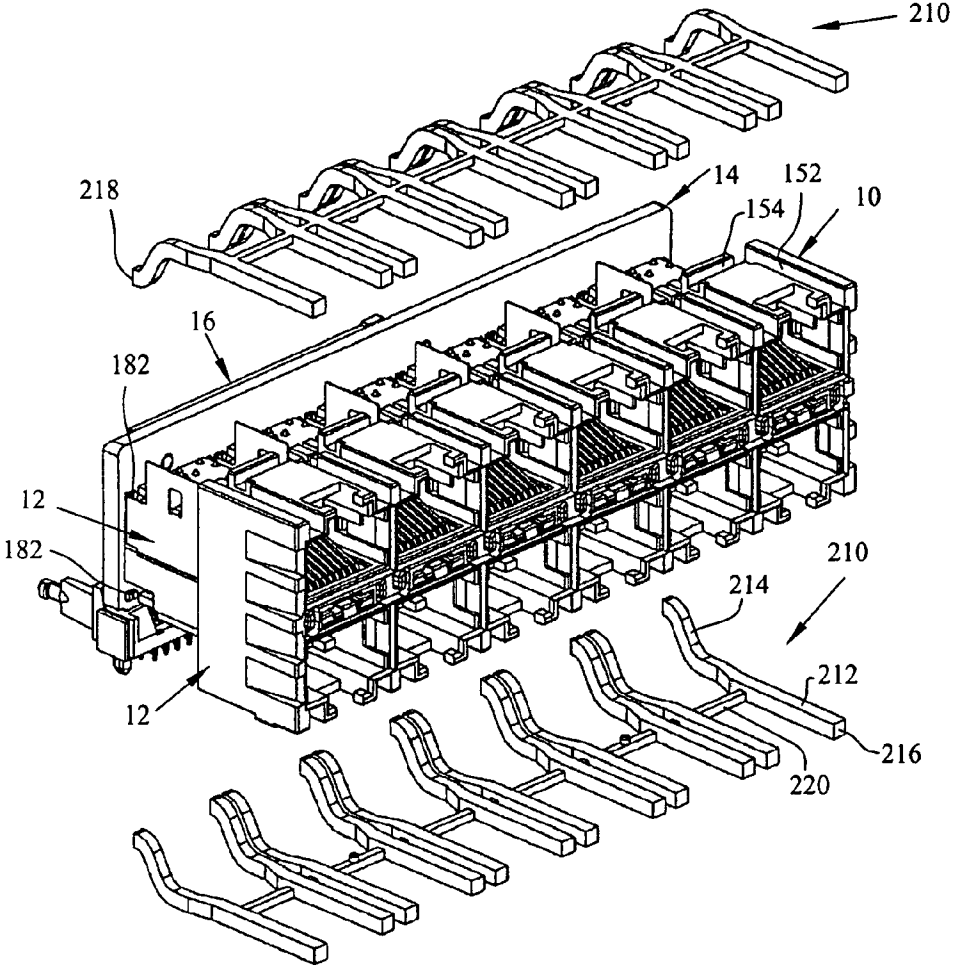
FIGS. 18–25 show progressive views of the assembly of the connector.

As shown in FIG. 18, light pipe 210 is provided, having elongate leg portions 212 and angled portions at 214 providing a front end 216 for emitting light and a rear end face at 218 for receiving light and a tie-bar member 220 therebetween. It should be appreciated that the light pipes 210 may be placed against the housing, such that elongate leg members 212 are provided in the grooves 152, and with tie bar 220 positioned in transverse groove 154, which positions end faces 218 adjacent to LEDs 182. It should also be appreciated that light pipes are comprised of a good light transmitting plastic, similar to the plastic from which fiber optic cable is made. Thus, as should be appreciated, light emitting from light emitting diodes 182 is projected onto front faces 216 of the light pipes 210.

Figure 19:
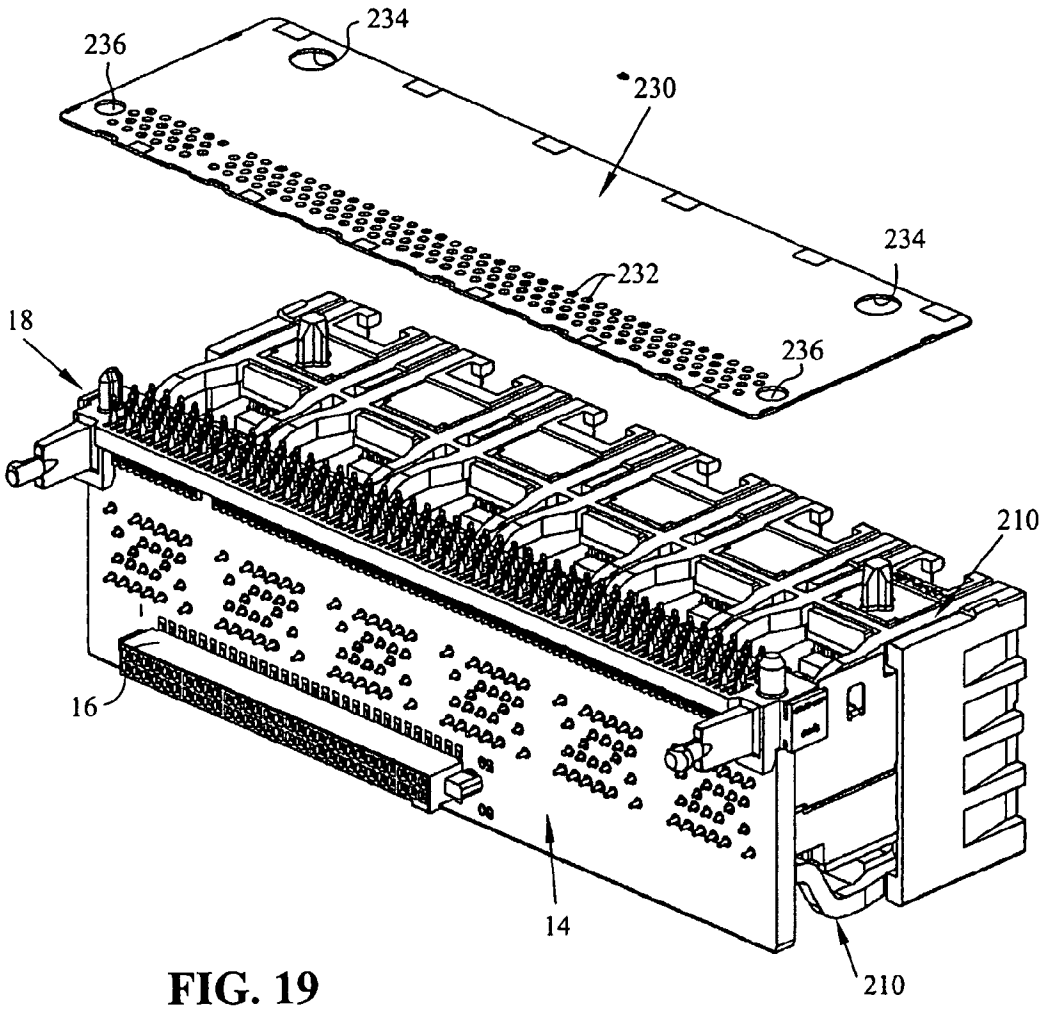

As shown in FIG. 19, light pipes 210 are shown in position in their respective grooves positioning end faces 218 adjacent to their respective LEDs 182. This provides a flush lower surface, as shown in FIG. 19, whereby tine plate 230 can be positioned over the lower surface with apertures 232 positioning the compliant pin portions of connector member 18. Tine plate 230 includes apertures 234, 236 for receipt over corresponding locating pegs on the bottom of the connector assembly, as shown in FIG. 19, which is well known in the art for locating the connector assembly relative to the motherboard.

Figure 20:
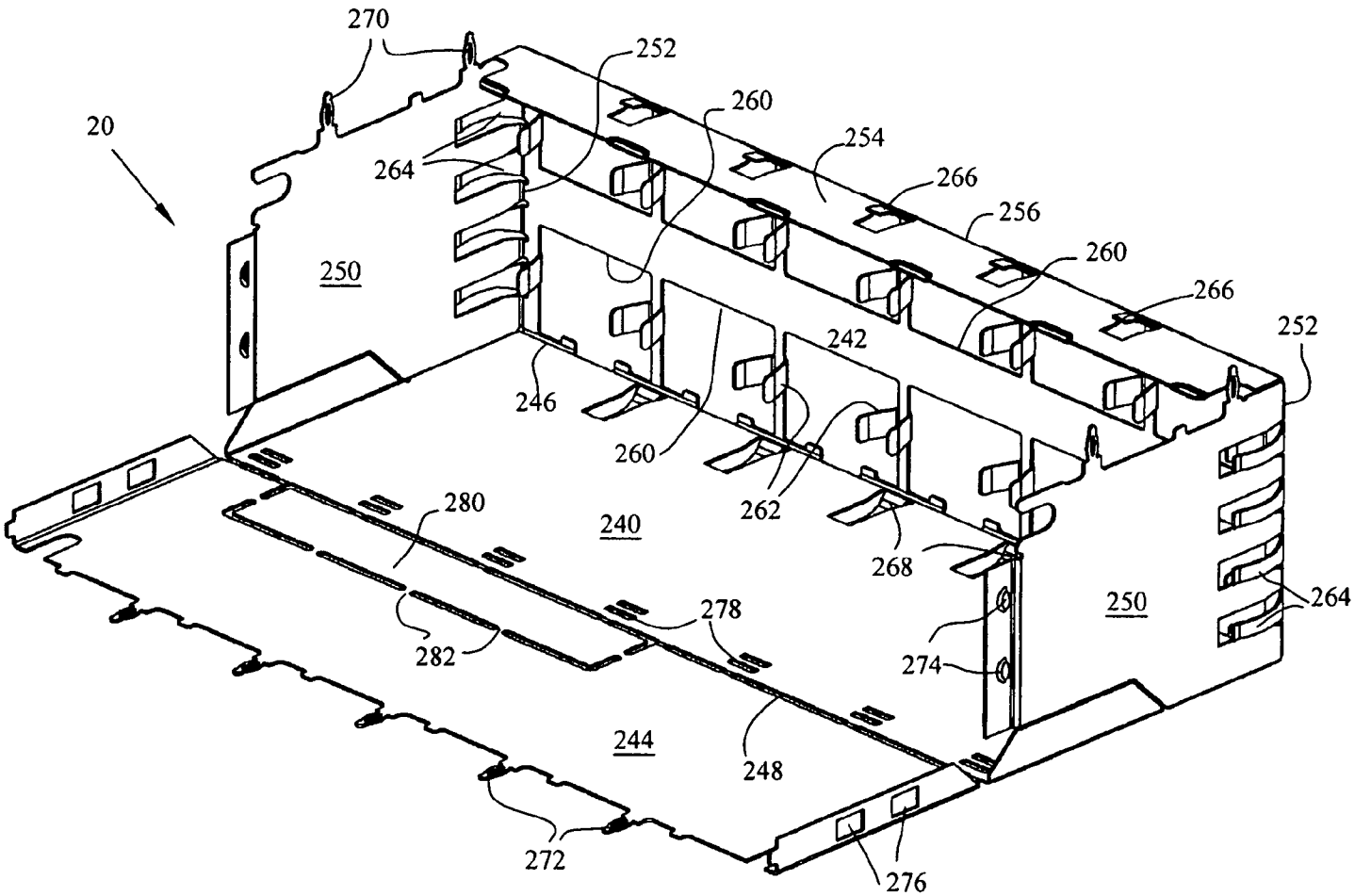

With respect now to FIG. 20, outer shield member 20 is shown, where the shield member is shown in an upside-down position resting on a top wall 240. Shield member 20 further includes a front wall 242 and a rear wall 244 extending integrally therefrom, along respective front and rear edges 246, 248. Meanwhile, side walls 250 are provided extending from side edges 252 of front wall 242. Finally, bottom wall 254 is provided integrally formed around a lower edge 256 of front wall 242.

As should be appreciated, front wall 242 includes a plurality of openings 260 appropriately positioned to be aligned with the plurality of ports defining the modular jack assembly. A pair of grounding tongues 262, which are biased inwardly so as to contact a shielded modular plug upon interconnection thereof, flanks each opening 260. Side walls 250 further include grounding tongues 264, while bottom wall 254 includes grounding tongues 266 and top wall 240 includes grounding tongues 268. Side walls 250 also include grounding tines 270 and rear wall 244 includes tines 272. As is well known in the art, shield 20 includes latching detents 274 at the end edge of side walls 250, which are profiled to latch with openings 276 in rear wall 244, when rear wall 244 is rotated into position. Top wall 240 also includes pairs of connection slots 278, as will be described further herein. Finally, rear wall 244 includes a knockout portion at 280 connected to rear wall 244 only by links 282 for easy removal thereof. It should also be appreciated that the location of the knockout 280 is positioned so as to overlie connector member 16 of main board 14.

Figure 21:
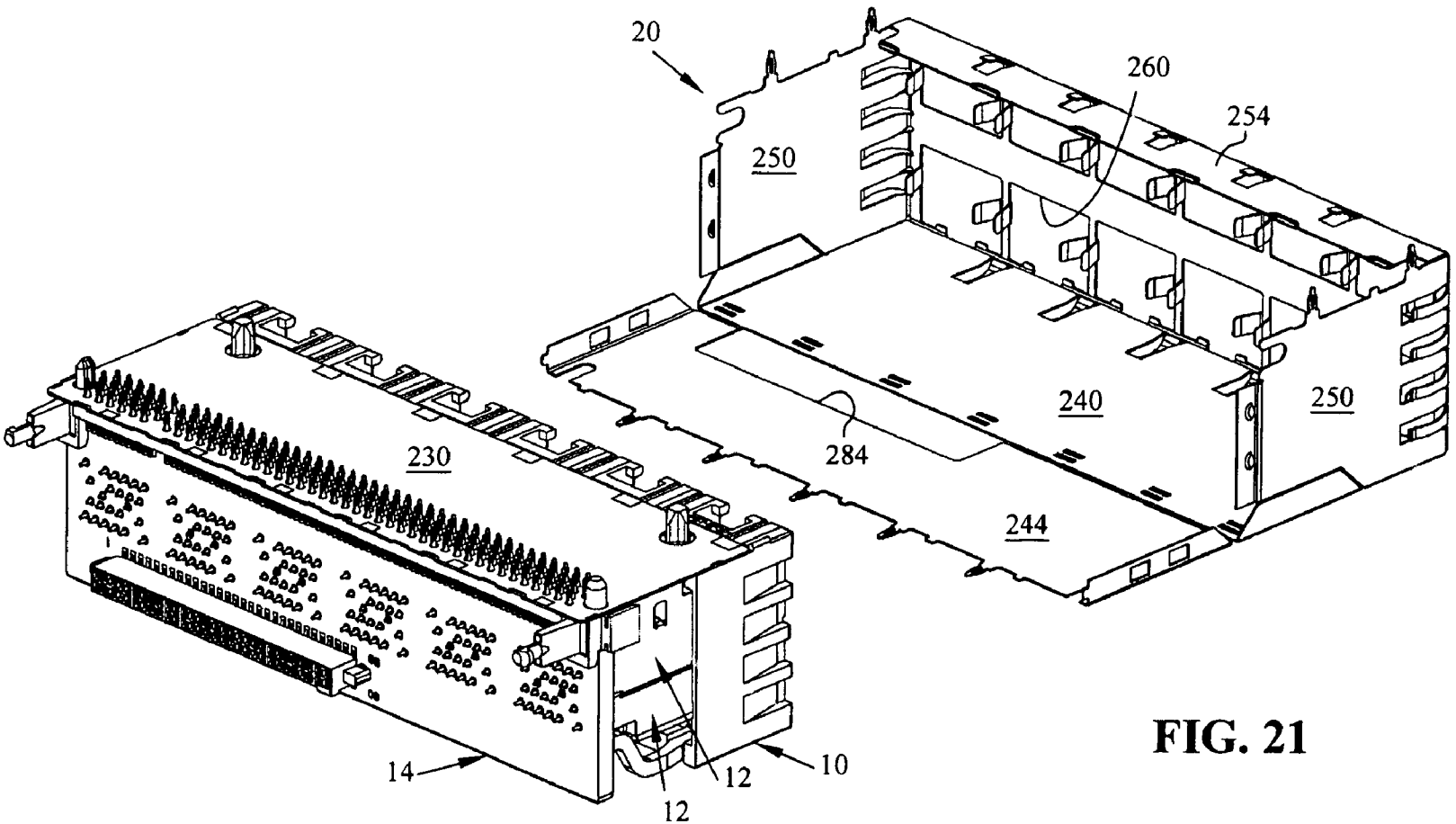
Figure 22:
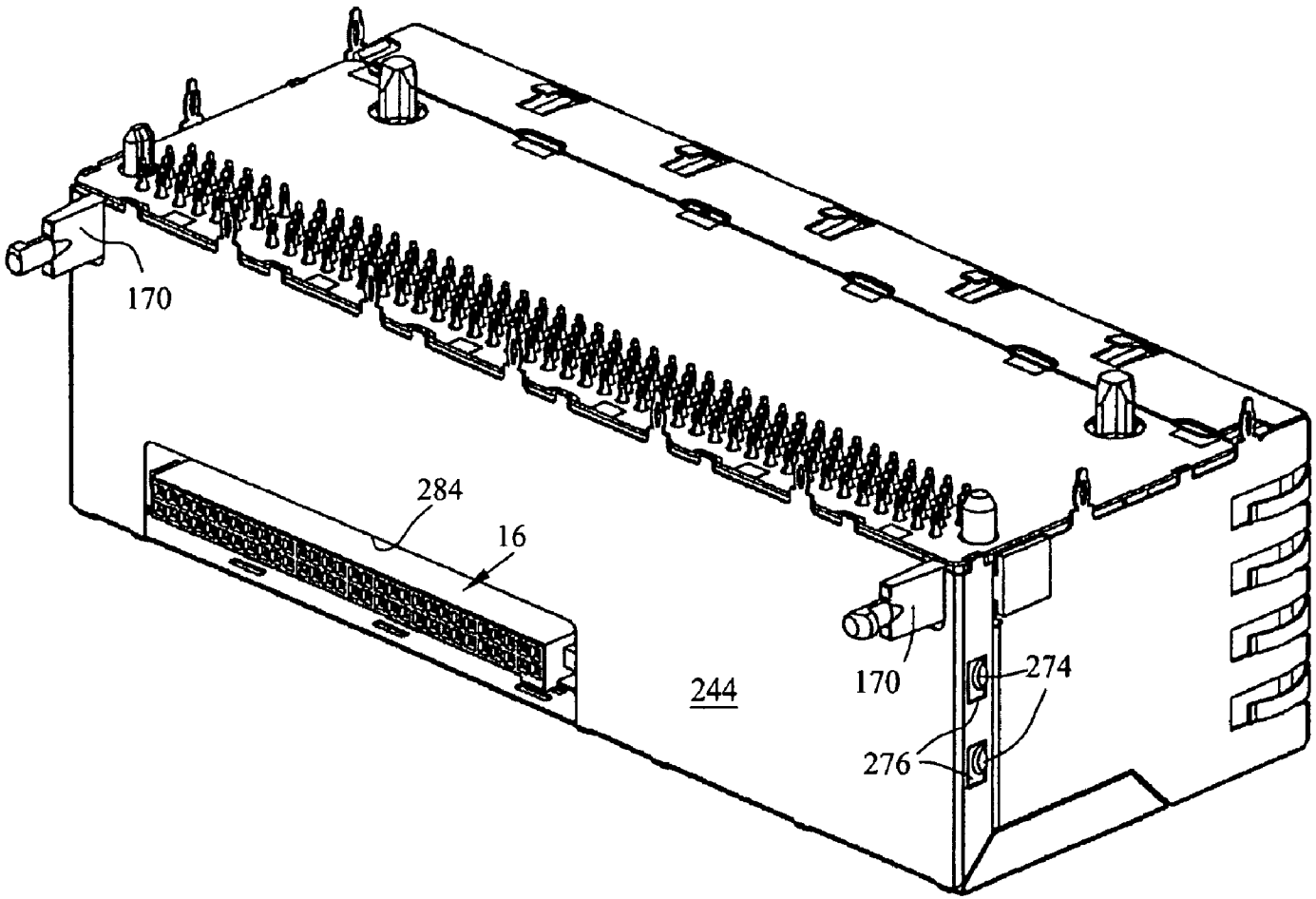

With respect now to FIG. 21, tine plate 230 is shown in the assembled position, and knockout 280 (FIG. 20) is shown removed, thereby defining opening 284. The assembly of housing 10, shielded subassembly 12 and main board 14 can thereby be slidably moved into position into shield 20 intermediate side walls 250 and beneath lower wall 254. As shown in FIG. 22, rear wall 244 is now rotated upwardly, such that apertures 276 overlap latching detents 274, which positions opening 284 over connector 16 and positions latching arms 170 exterior to rear wall 244.

Figure 23:
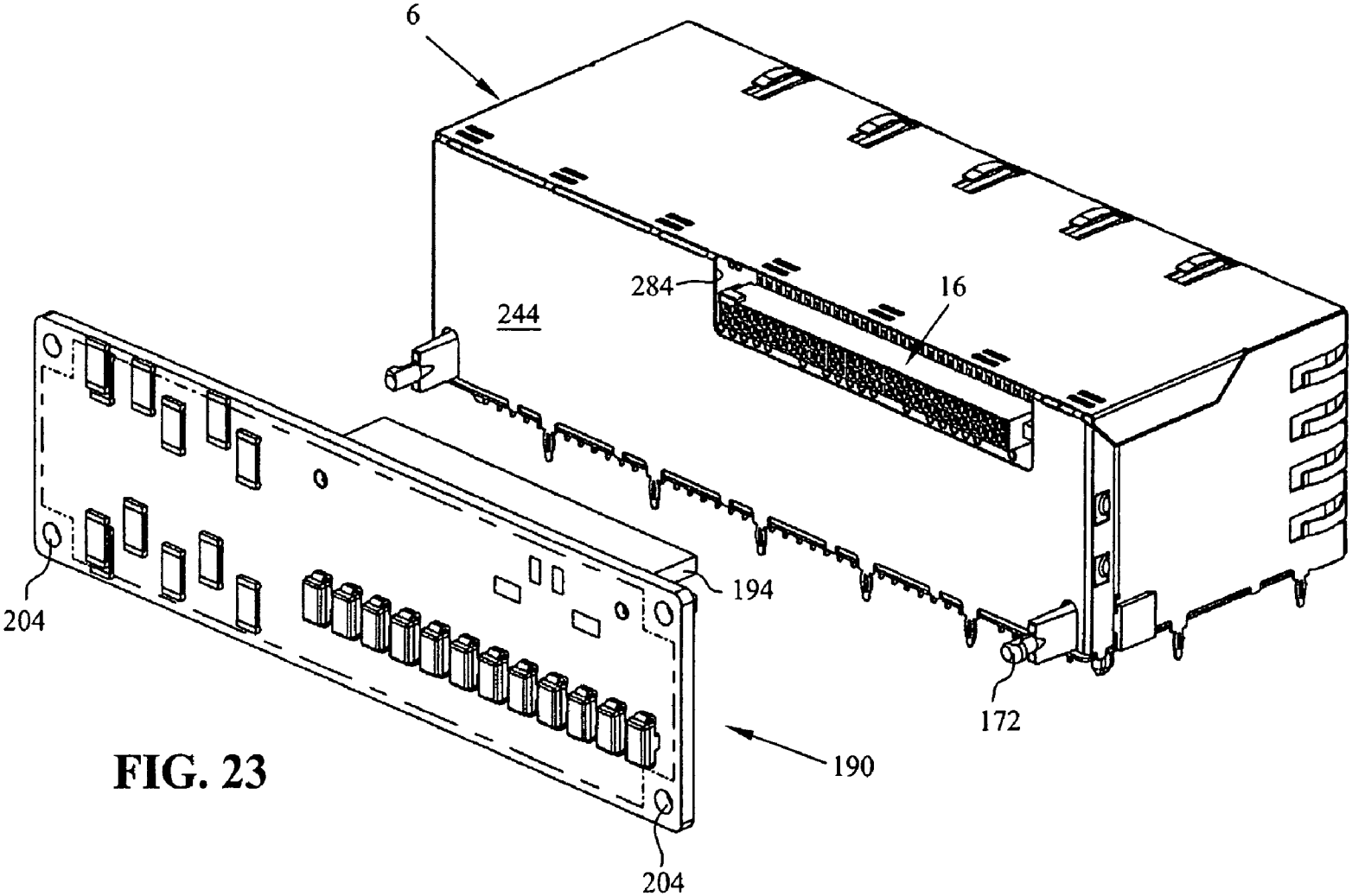
Figure 24:
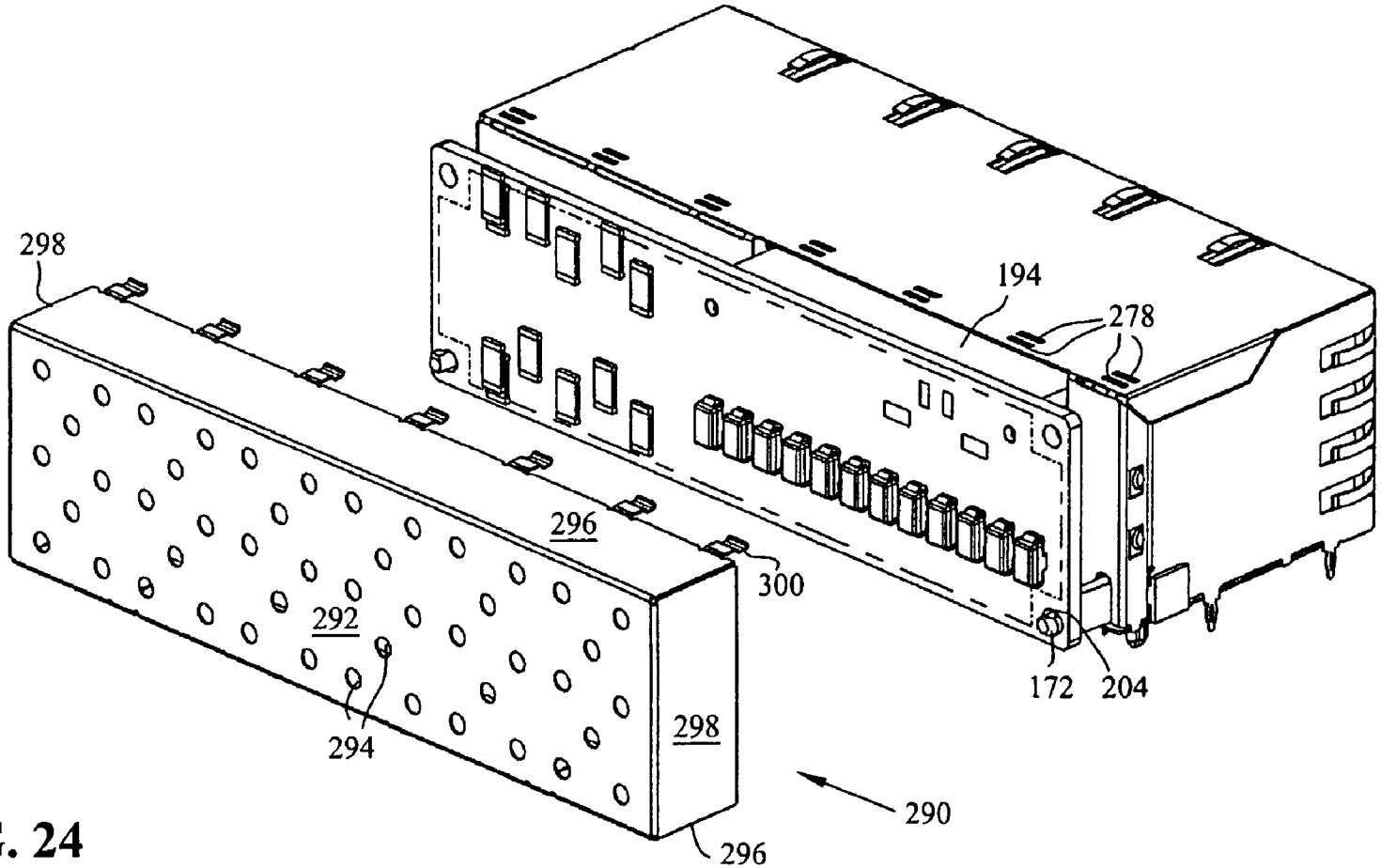
Figure 25:
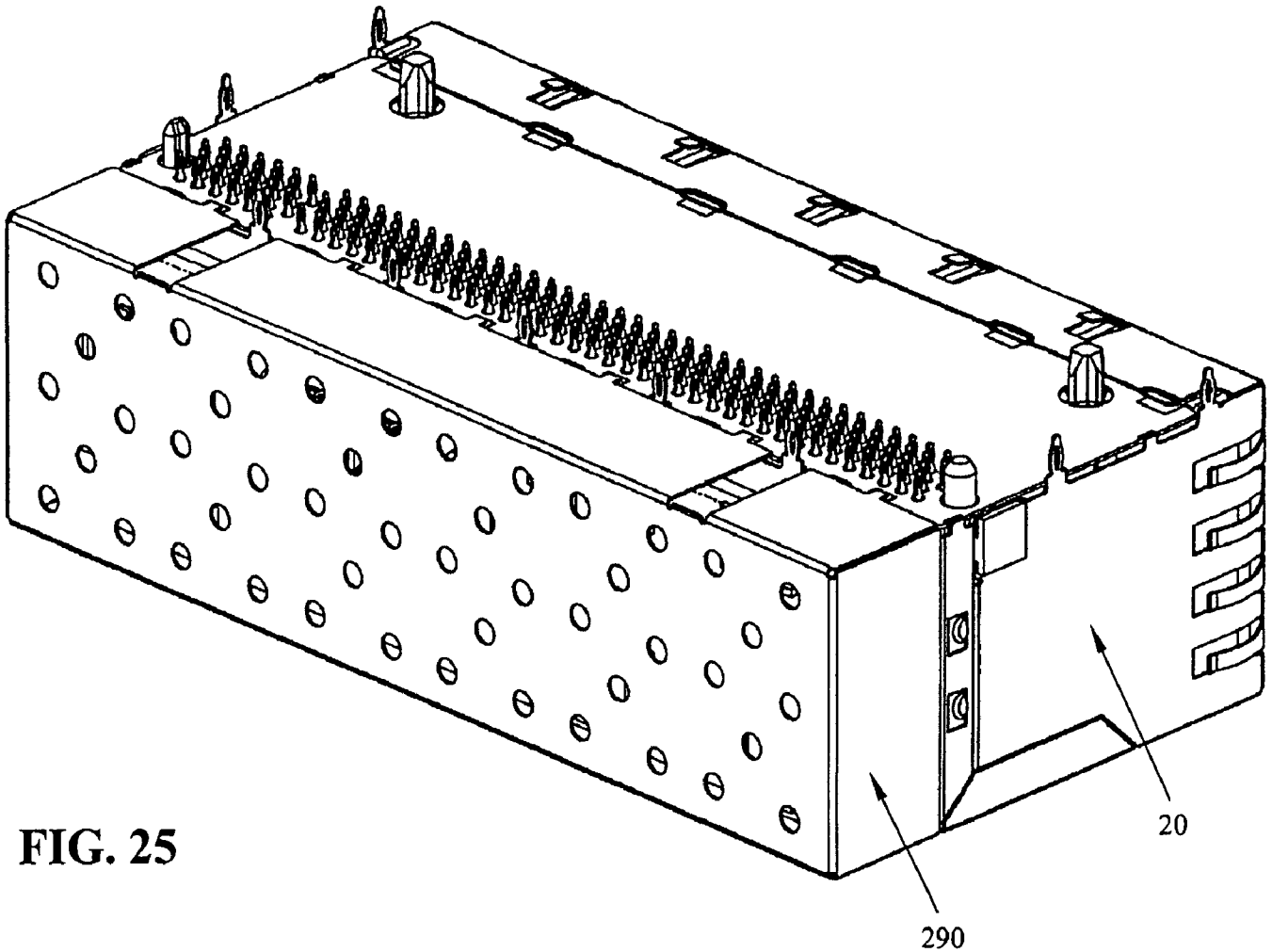

As shown in FIG. 23, power over ethernet card 190 may now be positioned adjacent to shielded assembly 6, whereby connectors 16 and 194 can be interconnected, which also provides a latching between latching lugs 172 and openings 204, as shown. As also shown in FIG. 24, rear shielded cover 290 is provided by main wall 292 having heat dissipation apertures 294, side walls 296 and end walls 298. Latching arms 300 also extend from side walls 296 and are profiled to be received in slots 278. It should be appreciated that cover 290 can be lifted and latch arms 300 rotated into slots 278 and into the position shown in FIG. 25.

Figure 27:
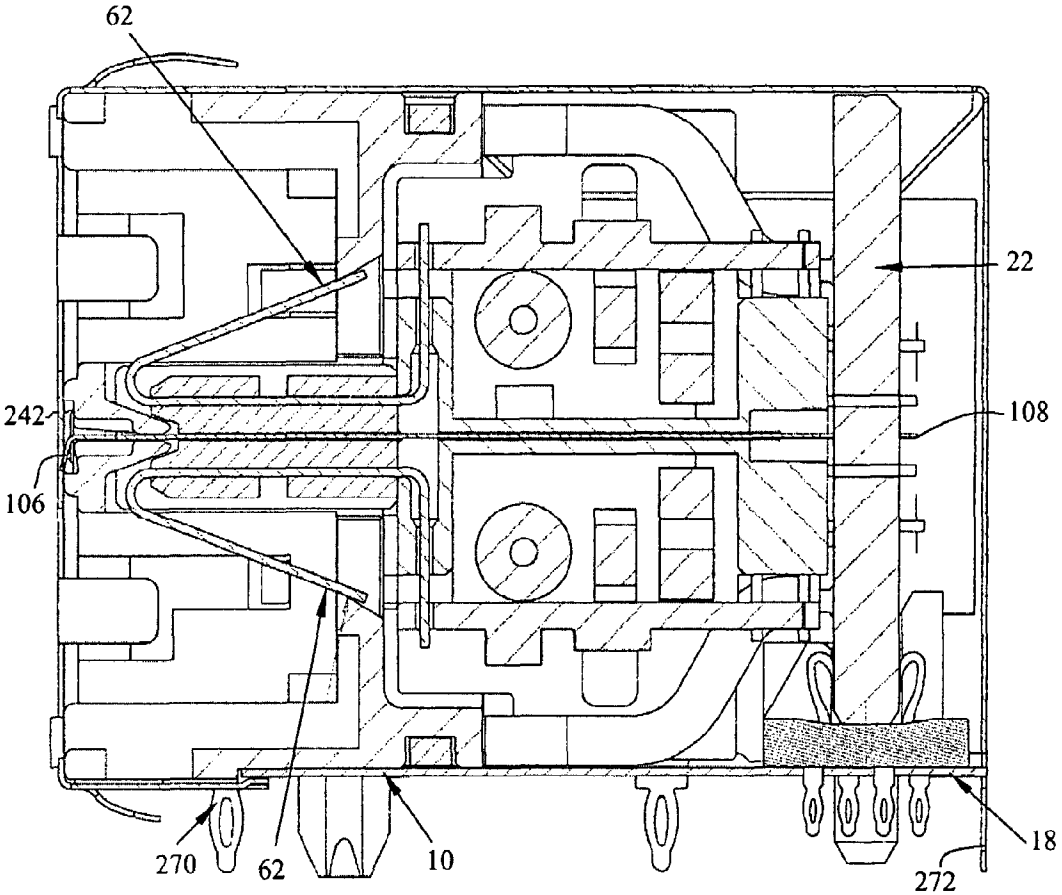
FIG. 27 is a cross-sectional view through lines 28—28 of FIG. 2.

With respect now to FIGS. 26 and 27, which are respectively cross-sectional views through lines 27—27 of FIG. 1 and lines 28—28 of FIG. 2, the internal construction of the as-assembled versions are shown. It also shows how identical constituent parts are utilized in the various assembled versions. For example, the constituent parts can provide for three different configurations of overall assembled versions. For example, main board 22 (FIG. 27) can have a first configuration, where the main board is circuit traces only, whereby the main board functions to electrically interconnect the plurality of modular jacks to a motherboard through the designated subset of traces 180*b* and contacts 162*b* (FIG. 6).

A second configuration is where main board 22 has circuit traces for electrically interconnecting the plurality of modular jack contacts 60 to the motherboard through the designated subset of terminals 162*b*. In addition, the main board 22 is enabled to receive conditioned electrical power signals for power over ethernet through another designated subset of traces 180*a* and 180*b* and terminals 162*a*.

Finally, a third configuration of the overall connection system provides for main board 14 having circuit traces for electrically interconnecting the modular jack contacts 60 to a motherboard through the designated subset of traces 180*b* and terminals 162*b* and in addition, the main board 14 provides an electrical connector 16 interconnected to the main board. A further power over ethernet conditioning board is connectable directly with connector 16, whereby the main board is adapted to receive unconditioned electrical power signals for power over ethernet through a second designated subset of terminals 162*a* and route them through the power over ethernet conditioning board and then through designated ones of the modular jack contacts 60.

Figure 28:
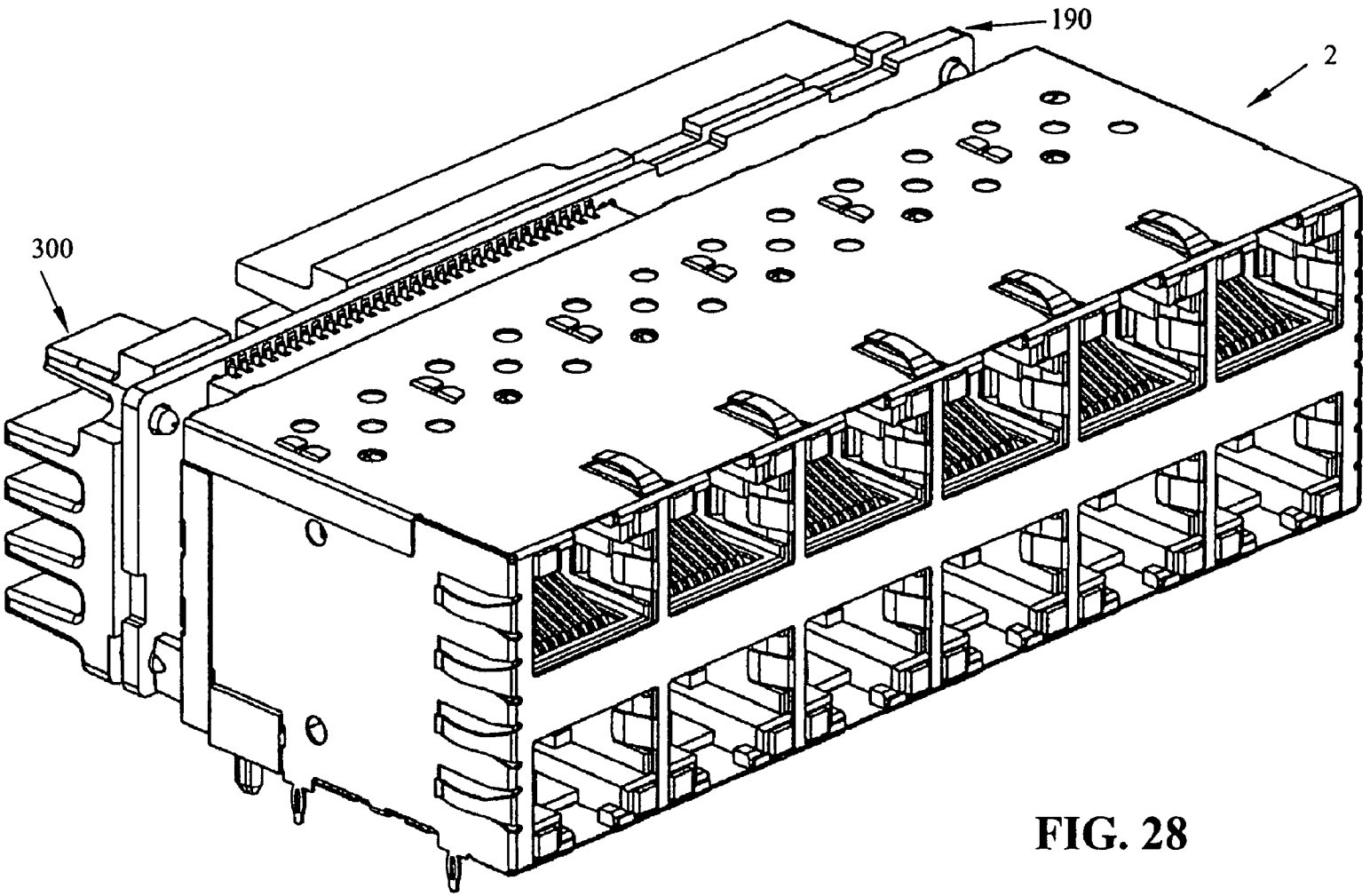
FIG. 28 shows an alternate embodiment of FIG. 1 having a heat sink connected to the power over ethernet card.
Figure 29:
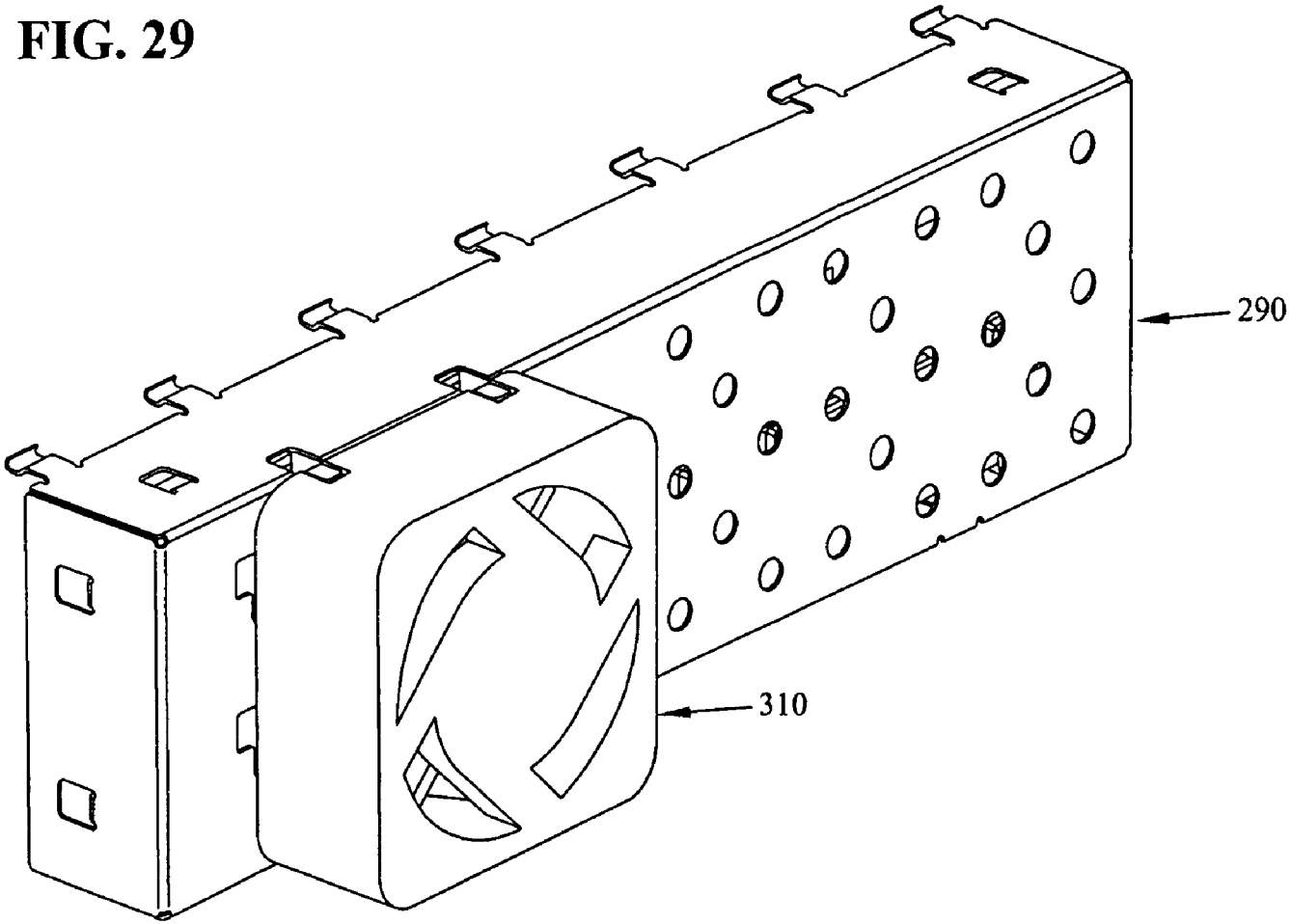
FIGS. 29 and 30 show an alternate embodiment of FIG. 29 having a fan interconnected to the power over ethernet card.
Figure 30:
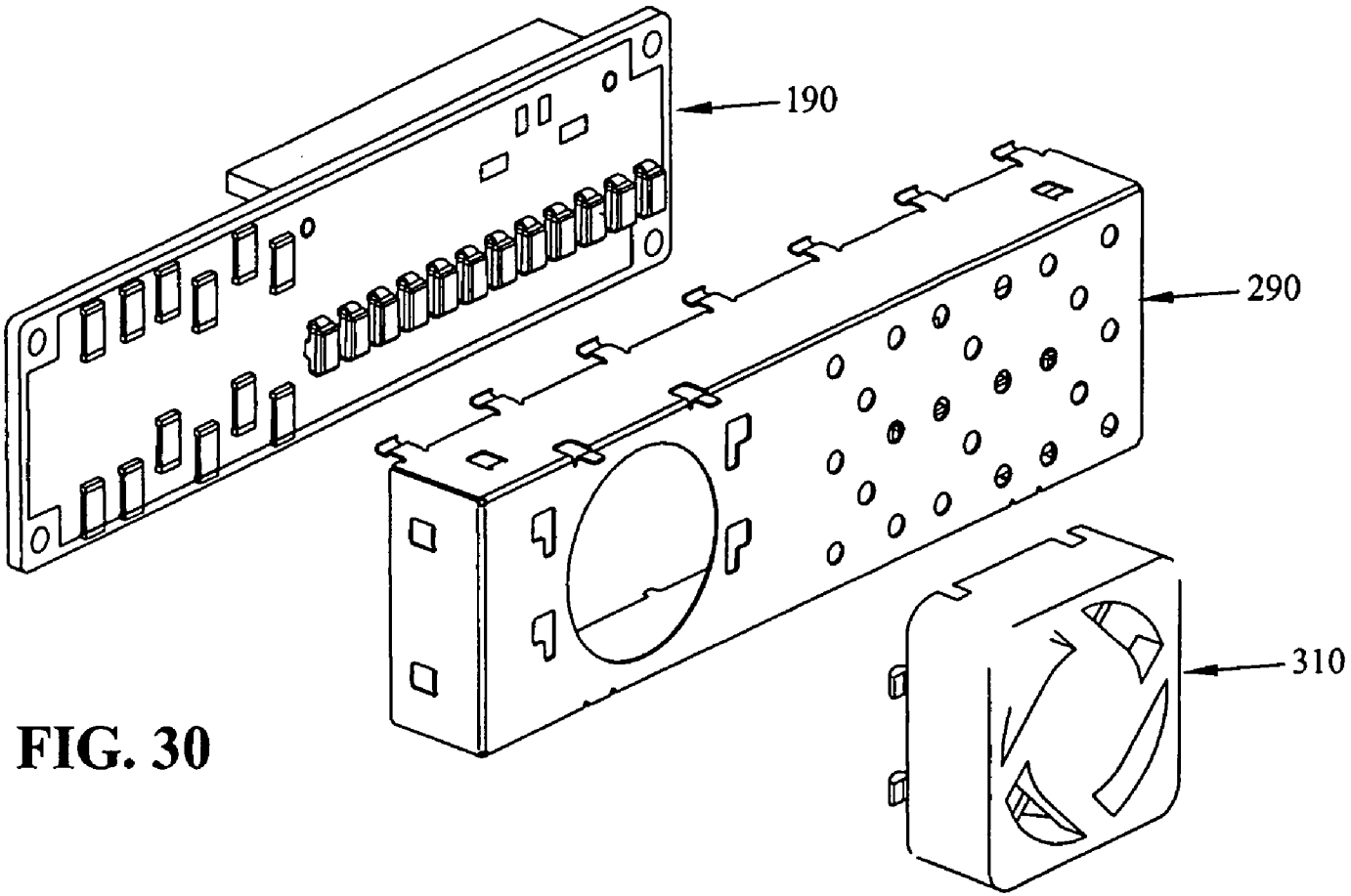

With respect now to FIGS. 28–30, heat-removal devices can be provided in the case of the integrated version, whereby a heat sink 300 can be applied to selected portions of the power over ethernet card, as shown in FIG. 28. Alternatively, as shown in FIGS. 29 and 30, a fan 310 can be applied directly to rear cover 290 to remove heat from the power over ethernet card.

What is claimed is:

1. A multi-port jack assembly, comprising:

a multi-port electrical connector housing having a plurality of housing ports adjacent a mating face of said connector housing;

a conductive shield member comprising a base shield portion and sidewall portions extending from side edges of said base shield portion, said sidewall portions extending in opposite directions from said base shield portion;

a plurality of modular connector subassemblies each comprising an insulative housing assembly and electrical terminal assemblies therein, said insulative housing assemblies being adapted for stacking with said base shield portion positioned therebetween, and with one of said shield sidewall portions positioned against a side of one of said housings and the other said shield sidewall portion positioned against a side of said other housing.

2. The multi-port jack assembly of claim 1, wherein said insulative housings each comprise a modular jack housing portion and a signal conditioning housing portion.

3. The multi-pod jack assembly of claim 2, wherein said electrical terminal assemblies are comprised of modular jack terminals and circuit board contacts.

4. The multi-port jack assembly of claim 3, further comprising a signal conditioning board having signal conditioning components thereon positioned in said signal conditioning housing portion, with said modular jack terminals and said circuit board portions electrically connected to said signal conditioning board.

5. The multi-port jack assembly of claim 4, wherein said modular jack housing is comprised of an over molded portion over said plurality of modular jack electrical terminals.

6. The multi-port jack assembly of claim 4, wherein said signal conditioning board includes ground traces thereon, and said shield sidewall portions each include a tab portion extending therefrom and electrically connected to said ground traces.

7. The multi-port jack assembly of claim 1, further comprising a signal conditioning board having signal conditioning components thereon, with said electrical terminal assemblies connecting through said signal conditioning boards, and said shield sidewall portions each include a tab portion extending therefrom and electrically connected to said ground traces.

8. The multi-port jack assembly of claim 1, further comprising an outer shield portion in a substantially surrounding relation with said multi-port connector housing.

9. The multi-port jack assembly of claim 8, wherein said outer shield portion includes a front shield wall portion and said base shield portions include grounding contacts extending forwardly and integrally therefrom and adapted for electrical contact with said front shield wall portion.

10. The multi-port jack assembly of claim 1, wherein said base shield portions Include printed circuit grounding contacts extending integrally and rearwardly therefrom and form grounding circuit board portions.

11. A multi-port jack assembly, comprising a multi-port electrical connector housing, a conductive shield member and a plurality of modular connector subassemblies, said multi-port electrical connector housing having a plurality of housing ports adjacent a mating face of said connector housing; said shield member comprising a base shield portion and at least one sidewall portion extending from a side edge of said base shield portion, and at least one insulative housing assembly having electrical terminal assemblies therein, said insulative housing assembly being positioned against said base shield portion with said shield sidewall portion positioned against a side of said housing; said modular connector assembly further comprising a signal conditioning board having signal conditioning components and a ground trace thereon, said shield sidewall portion including a tab portion extending therefrom and electrically connected to said ground trace.

12. The multi-port jack assembly of claim 11, wherein said jack assembly includes a plurality of modular connector subassemblies each comprising an insulative housing assembly and electrical terminal assemblies therein, and said shield member comprising at least two shield side wall portions extending in opposite directions from said base shield portion, said insulative housing assemblies being adapted for stacking with said base shield portion positioned therebetween, and with one of said shield sidewall portions positioned against a side of one of said housings and the other said shield sidewall portion positioned against a side of said other housing.

13. The multi-port jack assembly of claim 12, wherein said insulative housings each comprise a modular jack bowing portion and a signal conditioning housing portion.

14. The multi-port jack assembly of claim 13, wherein said electrical terminal assemblies are comprised of modular jack terminals and circuit board contacts.

15. The multi-port jack assembly of claim 14, wherein said signal conditioning board has signal conditioning components thereon positioned in said signal conditioning housing portion, with said modular jack terminals and said circuit board portions electrically connected to said signal conditioning board.

16. The multi-port jack assembly of claim 15, wherein said modular jack housing is comprised of an over molded portion over said plurality of modular jack electrical terminals.

17. The multi-port jack assembly of claim 11, wherein each said signal conditioning board includes a ground trace thereon, and each said shield sidewall portion includes a tab portion extending therefrom and electrically connected to respective ground traces.

18. The multi-port jack assembly of claim 11, further comprising an outer shield portion in a substantially surrounding relation with said multi-port connector housing.

19. The multi-port jack assembly of claim 18, wherein said outer shield portion includes a front shield wall portion and said base shield portions include grounding contacts extending forwardly and integrally therefrom and adapted for electrical contact with said front shield wall portion.

20. The multi-port jack assembly of claim 11, wherein said base shield portions include printed circuit grounding contacts extending integrally and rearwardly therefrom and form grounding circuit board portions.

* * * * *